US009238890B2

(12) United States Patent
Maladen et al.

(10) Patent No.: US 9,238,890 B2
(45) Date of Patent: Jan. 19, 2016

(54) FIBROUS STRUCTURES

(71) Applicant: The Procter & Gamble Company, Cincinnati, OH (US)

(72) Inventors: Ryan Dominic Maladen, Anderson Township, OH (US); Osman Polat, Montgomery, OH (US); Anja Werth, Highland Park, NJ (US); John Allen Manifold, Sunman, IN (US); Andre Mellin, Amberley Village, OH (US); Douglas Jay Barkey, Salem Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/224,224

(22) Filed: Mar. 25, 2014

(65) Prior Publication Data

US 2015/0275431 A1 Oct. 1, 2015

(51) Int. Cl.

| | |
|---|---|
| ***D21F 1/00*** | (2006.01) |
| ***D21G 9/00*** | (2006.01) |
| ***D21F 11/00*** | (2006.01) |
| ***D21F 11/04*** | (2006.01) |
| ***B31F 1/12*** | (2006.01) |

(52) U.S. Cl.
CPC ..... *D21F 11/006* (2013.01); *B31F 1/126* (2013.01); *D21F 11/04* (2013.01)

(58) Field of Classification Search
USPC ..... 162/109, 112, 111, 116, 123, 132, 197, 162/202, 204, 280, 281, 289, 296, 308, 309, 162/900–903; 428/156, 170
See application file for complete search history.

(56) References Cited

U.S. PATENT DOCUMENTS

| | | | | |
|---|---|---|---|---|
| 4,191,609 | A | 3/1980 | Trokhan | |
| 5,674,663 | A | 10/1997 | McFarland et al. | |
| 6,547,928 | B2 | 4/2003 | Barnholtz et al. | |
| 6,878,238 | B2 * | 4/2005 | Bakken | D21F 1/0054 156/166 |
| 7,041,196 | B2 * | 5/2006 | Lorenz | D21F 11/006 162/109 |
| 7,128,809 | B2 | 10/2006 | Vinson et al. | |
| 7,691,229 | B2 | 4/2010 | Vinson et al. | |
| 7,744,723 | B2 | 6/2010 | Sheehan et al. | |
| 8,298,376 | B2 | 10/2012 | Polat et al. | |
| 8,313,617 | B2 | 11/2012 | Polat et al. | |
| 8,911,850 | B2 | 12/2014 | Kien et al. | |
| 2004/0084167 | A1 | 5/2004 | Vinson et al. | |

(Continued)

OTHER PUBLICATIONS

PCT International Search Report dated Jun. 29, 2015—6 pages.

(Continued)

*Primary Examiner* — Dennis Cordray
(74) *Attorney, Agent, or Firm* — Roddy M. Bullock

(57) ABSTRACT

A method for making a multiply fibrous structure. The method comprising the steps of: depositing a slurry of pulp fibers onto a Fourdrinier wire running at a first velocity $V_1$; transferring the web from the Fourdrinier wire to at least a first molding member moving at a second velocity, $V_2$, slower than the first velocity, $V_1$. The molding member comprises a substantially continuous relatively low density network at least partially defining a plurality of relatively high density, irregularly shaped, discrete elements situated in an irregular pattern. The embryonic web is partially dried, adhered to a Yankee dryer surface, creped from Yankee dryer and reeled at a velocity, $V_4$, that is faster than that ($V_3$) of the Yankee dryer.

20 Claims, 22 Drawing Sheets

(56) References Cited

U.S. PATENT DOCUMENTS

| | | | | |
|---|---|---|---|---|
| 2006/0088696 | A1* | 4/2006 | Manifold | D21F 11/006 428/174 |
| 2006/0088697 | A1* | 4/2006 | Manifold | D21H 27/02 428/174 |
| 2006/0266484 | A1 | 11/2006 | Vinson et al. | |
| 2006/0278298 | A1* | 12/2006 | Ampulski | D21F 1/0036 139/383 B |
| 2006/0280909 | A1* | 12/2006 | Kien | D21H 27/02 428/156 |
| 2007/0272381 | A1* | 11/2007 | Elony | B32B 29/00 162/123 |
| 2009/0297775 | A1 | 12/2009 | Spitzer et al. | |
| 2010/0297395 | A1 | 11/2010 | Mellin et al. | |
| 2012/0043036 | A1 | 2/2012 | Polat et al. | |
| 2012/0043041 | A1 | 2/2012 | Polat et al. | |
| 2012/0043042 | A1 | 2/2012 | Polat et al. | |
| 2012/0180971 | A1 | 7/2012 | Polat et al. | |
| 2013/0209749 | A1 | 8/2013 | Myangiro et al. | |

OTHER PUBLICATIONS

All Office Actions in U.S. Appl. Nos. 14/224,176; U.S. Appl. No. 14/224,186; and U.S. Appl. No. 14/224,201; and U.S. Appl. No. 14/224,224.

PCT International Search Report for co-pending case dated Jul. 7, 2015—5 pages.

* cited by examiner

Moments

| | |
|---|---|
| 100% maximum | 80.3057 |
| 99.5% | 80.3057 |
| 97.5% | 80.3057 |
| 90.0% | 71.6743 |
| 75.0% quartile | 57.0441 |
| 50.0% median | 37.7022 |
| 25.0% quartile | -50.339 |
| 10.0% | -62.566 |
| 2.5% | -76.468 |
| 0.5% | -89.931 |
| 0.0% minimum | -89.931 |

Moments

| | |
|---|---|
| Mean | 15.148202 |
| Std Dev | 53.542916 |
| Std Err Mean | 5.6439189 |
| Upper 95% | 26.362549 |
| Lower 95% | 3.9338558 |
| N | 90 |

FIBROUS STRUCTURES

FIELD

The present disclosure generally relates to fibrous structures and, more particularly, relates to fibrous structures comprising discrete elements situated in irregular patterns.

BACKGROUND

Fibrous structures, such as sanitary tissue products, for example, are useful in many ways in every day life. These products can be used as wiping implements for post-urinary and post-bowel movement cleaning (toilet tissue and wet wipes), for otorhinolaryngological discharges (facial tissue), and multi-functional absorbent and cleaning uses (paper towels). In some instances, consumers desire their fibrous structures to be soft to the touch, flexible (conformable to a hand), cushiony, absorbent, and strong, for example. Consumers also desire above-average cleaning ability, or at least the appearance of above-average cleaning ability, in their fibrous structures, especially for toilet tissue and paper towels, for example. The existing art can be improved, and the consumer desired results can be achieved, by the fibrous structures of the present disclosure.

SUMMARY

A method for making a multiply fibrous structure is disclosed. In an embodiment, the method comprising the steps of:

depositing a slurry of pulp fibers from a headbox of a paper making machine onto a Fourdrinier wire running at a first velocity $V_1$ to form an embryonic web;

transferring the embryonic web from the Fourdrinier wire to at least a forming member moving at a second velocity, $V_2$, where the second velocity, $V_2$, is slower than the first velocity, $V_1$, and the forming member comprises a substantially continuous relatively low density network at least partially defining a plurality of relatively high density, irregularly shaped, discrete elements situated in an irregular pattern, wherein each of the discrete element has at least one arcuate portion on their outer perimeter, a major axis, A, and a minor axis, B, and wherein the length of the major axis, A, is greater than or equal to the length of the minor axis, B;

de-watering the embryonic web by through air drying to at least partially dry it;

adhering the partially dried web to a Yankee dryer surface for further drying, the Yankee dryer surface moving at a third velocity, $V_3$, to dry the web to a dry web consistency of at least 92%;

creping the dried web off the Yankee dryer;

reeling the creped, dried web onto a take up roll, the take up roll having a fourth velocity, $V_4$, that is faster than the third velocity, $V_3$, of the Yankee dryer.

BRIEF DESCRIPTION OF THE DRAWINGS

The above-mentioned and other features and advantages of the present disclosure, and the manner of attaining them, will become more apparent and the disclosure itself will be better understood by reference to the following description of non-limiting embodiments of the disclosure taken in conjunction with the accompanying drawings, wherein.

DETAILED DESCRIPTION

Figure 1:
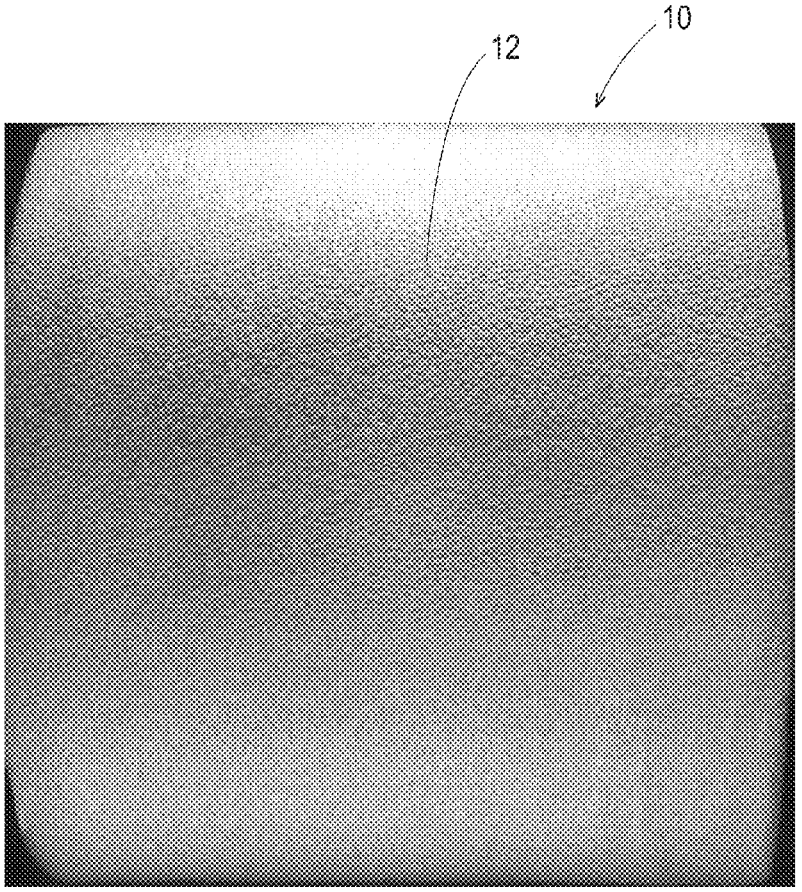
FIG. 1 is a front perspective view of a roll of a fibrous structure in accordance with one non-limiting embodiment.

Various non-limiting embodiments of the present disclosure will now be described to provide an overall understanding of the principles of the structure, function, manufacture, and use of the fibrous structures disclosed herein. One or more examples of these non-limiting embodiments are illustrated in the accompanying drawings. Those of ordinary skill in the art will understand that the fibrous structures described herein and illustrated in the accompanying drawings are non-limiting example embodiments and that the scope of the various non-limiting embodiments of the present disclosure are defined solely by the claims. The features illustrated or described in connection with one non-limiting embodiment can be combined with the features of other non-limiting embodiments. Such modifications and variations are intended to be included within the scope of the present disclosure.

"Fiber" as used herein means an elongate physical structure having an apparent length greatly exceeding its apparent diameter (i.e., a length to diameter ratio of at least about 10). Fibers having a non-circular cross-section and/or a tubular shape are common. The "diameter" in this case can be considered to be the diameter of a circle having a cross-sectional area equal to the cross-sectional area of the fiber. More specifically, as used herein, "fiber" refers to fibrous structure-making fibers. The present disclosure contemplates the use of a variety of fibrous structure-making fibers, such as, for example, natural fibers or synthetic fibers, or any other suitable fibers, and any combination thereof.

In one embodiment of the present disclosure, "fiber" refers to fibrous structure making fibers, which can be papermaking fibers. Fibrous structure or papermaking fibers useful in the present disclosure comprise cellulosic fibers, commonly known as wood pulp fibers. Applicable wood pulps comprise chemical pulps, such as Kraft, sulfite, and sulfate pulps, as well as mechanical pulps including, for example, groundwood, thermomechanical pulp and chemically modified thermomechanical pulp. Chemical pulps, however, can also be used since they can impart a superior tactile sense of softness to tissue sheets made therefrom. Pulps derived from both deciduous trees (hereinafter, also referred to as "hardwood") and coniferous trees (hereinafter, also referred to as "softwood") can be utilized. The hardwood and softwood fibers can be blended, or alternatively, can be deposited in layers to provide a stratified web. U.S. Pat. No. 4,300,981 to Carstens and U.S. Pat. No. 3,994,771 to Morgan, Jr. et al. illustrate examples of the layering of hardwood and softwood fibers. Also applicable to the present disclosure are fibers derived from pre- or post-consumer recycled paper, which can contain any or all of the above categories as well as other non-fibrous materials such as fillers and adhesives used to facilitate the original papermaking process.

In addition to the various wood pulp fibers, other cellulosic fibers such as cotton linters, rayon, lyocell and bagasse can be used in the present disclosure. Other sources of cellulose in the form of fibers, or capable of being spun into fibers, comprise grasses and grain sources.

"Fibrous structure" as used herein means a structure that comprises one or more fibers. Paper is a fibrous structure. Nonlimiting examples of processes for making fibrous structures include known wet-laid papermaking processes and air-laid papermaking processes, and embossing and printing processes. Such processes typically comprise the steps of preparing a fiber composition in the form of a suspension in a medium, either wet, more specifically aqueous medium, or dry, more specifically gaseous (i.e., with air as medium). The aqueous medium used for wet-laid processes is oftentimes referred to as a fiber slurry. The fibrous suspension is then used to deposit a plurality of fibers onto a forming wire or papermaking belt such that an embryonic fibrous structure can be formed, after which drying and/or bonding the fibers together results in a fibrous structure. Further processing the fibrous structure can be carried out such that a finished fibrous structure can be formed. For example, in typical papermaking processes, the finished fibrous structure is the fibrous structure that is wound on the reel at the end of papermaking, and can subsequently be converted into a finished product (e.g., a sanitary tissue product).

"Sanitary tissue product" as used herein means one or more finished fibrous structures, converted or not, that is useful as a wiping implement for post-urinary and post-bowel movement cleaning (toilet tissue and wet wipes), for otorhinolaryngological discharges (facial tissue), and multi-functional absorbent and cleaning uses (paper towels). The sanitary tissue products can be embossed or not embossed, creped or uncreped.

In one example, the sanitary tissue products of the present disclosure can comprise one or more fibrous structures according to the present disclosure.

The sanitary tissue products and/or the fibrous structures of the present disclosure can exhibit a basis weight of greater than about 15 g/m$^2$ (9.2 lbs/3000 ft$^2$) to about 120 g/m$^2$ (73.8 lbs/3000 ft$^2$), alternatively from about 15 g/m$^2$ (9.2 lbs/3000 ft$^2$) to about 110 g/m$^2$ (67.7 lbs/3000 ft$^2$), alternatively from about 20 g/m$^2$ (12.3 lbs/3000 ft$^2$) to about 100 g/m$^2$ (61.5 lbs/3000 ft$^2$), and alternatively from about 30 g/m$^2$ (18.5 lbs/3000 ft$^2$) to about 90 g/m$^2$ (55.4 lbs/3000 ft$^2$). In addition, the sanitary tissue products and/or the fibrous structures of the present disclosure can exhibit a basis weight between about 40 g/m$^2$ (24.6 lbs/3000 ft$^2$) to about 120 g/m$^2$ (73.8 lbs/3000 ft$^2$), alternatively from about 50 g/m$^2$ (30.8 lbs/3000 ft$^2$) to about 110 g/m$^2$ (67.7 lbs/3000 ft$^2$), alternatively from about 55 g/m$^2$ (33.8 lbs/3000 ft$^2$) to about 105 g/m$^2$ (64.6 lbs/3000 ft$^2$), and alternatively from about 60 g/m$^2$ (36.9 lbs/3000 ft$^2$) to about 100 g/m$^2$ (61.5 lbs/3000 ft$^2$).

The sanitary tissue products and/or fibrous structures of the present disclosure can exhibit a density (measured at 95 g/in$^2$) of less than about 0.60 g/cm$^3$, alternatively less than about 0.30 g/cm$^3$, alternatively less than about 0.20 g/cm$^3$, alternatively less than about 0.10 g/cm$^3$, alternatively less than about 0.07 g/cm$^3$, alternatively less than about 0.05 g/cm$^3$, alternatively from about 0.01 g/cm$^3$ to about 0.20 g/cm$^3$, and alternatively from about 0.02 g/cm$^3$ to about 0.10 g/cm$^3$.

The sanitary tissue products and/or fibrous structures of the present disclosure can be in the form of sanitary tissue product rolls and/or fibrous structure rolls. Such sanitary tissue product rolls and/or fibrous structure rolls can comprise a plurality of connected, but perforated sheets of one or more fibrous structures, that are separably dispensable from adjacent sheets.

The sanitary tissue products and/or fibrous structures of the present disclosure can comprises additives such as softening agents, temporary wet strength agents, permanent wet strength agents, bulk softening agents, lotions, silicones, wetting agents, latexes, especially surface-pattern-applied latexes, dry strength agents such as carboxymethylcellulose and starch, and other types of additives suitable for inclusion in and/or on sanitary tissue products and/or fibrous structures.

"Major axis" as used herein means the axis formed between the two furthest perimeter points across the area of a discrete element of a fibrous structure, wherein the axis intersects a midpoint of the discrete element.

"Minor axis" as used herein means the axis formed between the two closest perimeter points across an area of a discrete element of a fibrous structure, wherein the axis intersects a midpoint of the major axis. In various embodiments, the minor axis can have a smaller length than the major axis.

"Orientation" for each discrete element, as used herein, means the angle formed between the machine direction of zero degrees and the major axis. The machine direction will be considered 0 degrees. The range of possible angles is from −90 degrees to 90 degrees, relative to the machine direction.

"Machine Direction" or "MD" as used herein means the direction on a web corresponding to the direction parallel to the flow of a fibrous web or fibrous structure through a fibrous structure making machine making machine.

"Cross Machine Direction" or "CD" as used herein means a direction perpendicular to the Machine Direction.

"Irregular element shape" as used herein means that the two sides of an element defined by the major axis are not equal in area, or the two sides of an element defined by the minor axis are not equal in area. The discrete elements in each fibrous structure can also have two or more shapes, two or more areas, and each can have at least one arcuate portion on its outer perimeter.

"Irregular pattern" as used herein means that the spacing between discrete elements in the machine direction is not consistent and spacing between discrete elements in the cross machine direction is not consistent as measured from the points created at the intersection of major axis and minor axis of the relevant discrete elements. The major axes of the discrete elements of a fibrous structure can have a bi-modal distribution.

"Uniform pattern" as used herein means that the spacing between discrete elements in the machine direction are consistent and spacing between elements in the cross machine direction are consistent as measured from the center point created by the intersection of major axis and minor axis of the relevant discrete element.

"Bi-modal distribution" as used herein means a frequency distribution of the major axes in the range of −90 to 90 degrees relative to a machine direction of 0 degrees of the discrete elements in a fibrous structure with two modes, the frequency exhibiting one mode being positive and the other mode being negative, on the positive side of the x-axis. See, for example, FIG. 13.

"Discrete element" as used herein means an element within a fibrous structure that has an elevation (i.e., a Z-direction deformation) and an area defined by a visibly distinctive perimeter. The perimeter can be considered to be in the transition region between a generally planar portion of a substrate and an adjacent elevated portion of a discrete element. Identifying the perimeter for purposes of the invention can be achieved by viewing under magnification a discrete element and physically or virtually inscribing a closed figure around the discrete element in the transition region, following the shape of the discrete element at a generally uniform elevation. It is not necessary that the area of a discrete element (or, e.g., other dimensional features such as the major and minor axes) be measured precisely, as long a consistent measurement technique is employed for all measured discrete elements. Discrete elements can be formed during a papermaking process, such as during formation of the embryonic web on a structured paper making forming belt or by wet-pressing or by molding into a structured paper-making drying belt or by dry-transferring with textured pressure roll (i.e., wet-formed discrete elements). Discrete elements can also be dry-formed in an embossing process or by re-wetting and pressing or by re-wetting and vacuum forming onto a molding template (i.e., dry-formed discrete elements).

"Relatively low density" as used herein means a portion of a fibrous structure having a density that is lower than a relatively high density portion. The relatively low density can be in the range of 0.02 g/cm$^3$ to 0.09 g/cm$^3$, for example relative to a high density that can be in the range of 0.1 to 0.13 g/cm$^3$.

"Relatively high density" as used herein means a portion of a fibrous structure having a density that is higher than a relatively low density portion. The relatively high density can be in the range of 0.1 to 0.13 g/cm$^3$, for example, relative to a low density that can be in the range of 0.02 g/cm$^3$ to 0.09 g/cm$^3$.

"Substantially continuous network" as used herein means a portion of a fibrous structure that at least partially defines or surrounds a plurality of discrete elements formed in the fibrous structure. The substantially continuous network will fully define or surround more of the discrete elements than it partially defines or surrounds. The substantially continuous network can be interrupted by macro patterns formed in the fibrous structure. The substantially continuous network can have a relatively high density or a relatively low density.

"Substantially continuous" as used herein with respect to high or low density networks means the fully define or surround more of the discrete deflection cells than it partially defines or surrounds. The substantially continuous member can be interrupted by macro patterns formed in the papermaking belt.

"Substantially continuous deflection conduit" as used herein means a portion of a papermaking belt that at least partially defines or surrounds a plurality of discrete portions raised from a reinforcing element of a papermaking belt. The substantially continuous conduit will fully define or surround more of the discrete portions raised from the reinforcing element than it partially defines or surrounds. The substantially continuous deflection conduit can be interrupted by macro patterns formed in the papermaking belt.

"Discrete deflection cell" as used herein means a portion of a papermaking belt defined or surrounded by, or at least partially defined or surrounded by, a substantially continuous network and that has an enclosed perimeter.

"Discrete raised portion" as used herein means a portion of a papermaking belt extending from a reinforcing element that is defined or surrounded by, or at least partially defined or surrounded by a substantially continuous deflection conduit and that has an enclosed perimeter.

"Basis Weight" as used herein is the weight per unit area of a sample reported in lbs/3000 ft$^2$ or g/m$^2$.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or a multi-ply sanitary tissue product. It is also contemplated that an individual, integral fibrous structure can effectively form a multi-ply fibrous structure, for example, by being folded on itself.

Fibrous Structures

The fibrous structures of the present disclosure can be single-ply or multi-ply fibrous structures and can comprise cellulosic pulp fibers. However, other naturally-occurring and/or non-naturally occurring fibers can also be present in the fibrous structures. In one example, the fibrous structures can be throughdried. In one example, the fibrous structures can be wet-laid fibrous structures. The fibrous structures can be incorporated into single- or multi-ply sanitary tissue products. The sanitary tissue products or fibrous structures can be in roll form where they are convolutedly wound or wrapped about themselves with or without the employment of a core. In other embodiments, the sanitary tissue products or fibrous structures can be in sheet form or can be at least partially folded over themselves.

Those of skill in the art will recognize that although the figures illustrate various examples of fibrous structures, sanitary tissue products, patterns, and papermaking belts of the present disclosure, those fibrous structures, sanitary tissue products, patterns, and papermaking belts are merely examples and are not intended to limit the present disclosure. Many other fibrous structures, including sanitary tissue products having irregular patterns or uniform patterns of discrete elements, can also be used to achieve the benefits and advantages of the fibrous structures or sanitary tissue products of the present disclosure. Although the fibrous structures of the present disclosure, in some figures, appear as "rolls", it is to be understood that the disclosure is not so limited. In fact, the fibrous structures or sanitary tissue products of the present disclosure also apply to flat fibrous structures, non-rolled fibrous structures, folded fibrous structures, and/or any other suitable formation for fibrous structures.

Figure 1A:
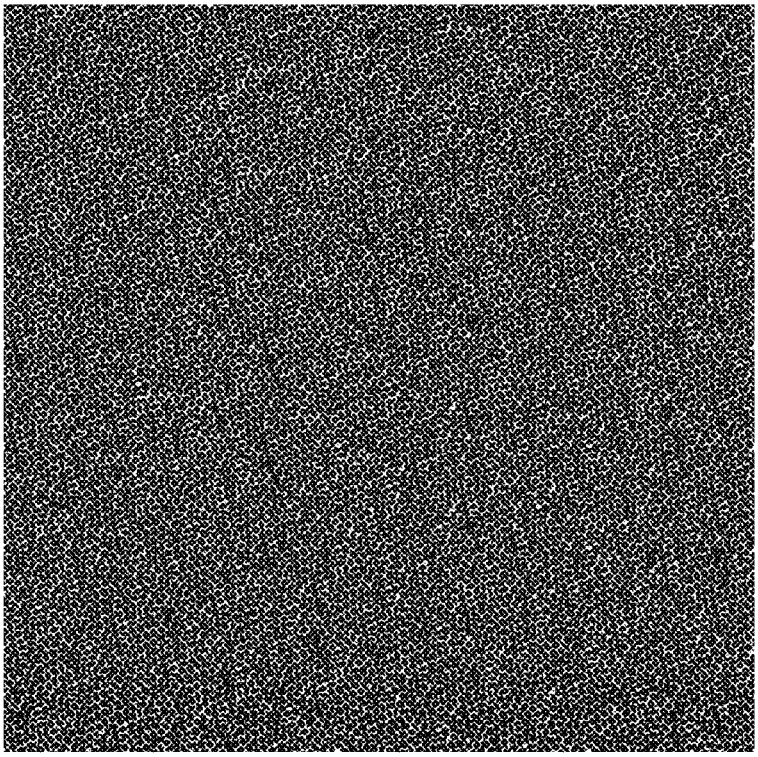
FIG. 1A is an illustration of a portion of a pattern used to make the fibrous structure of FIG. 1 in accordance with one non-limiting embodiment.
Figure 2:
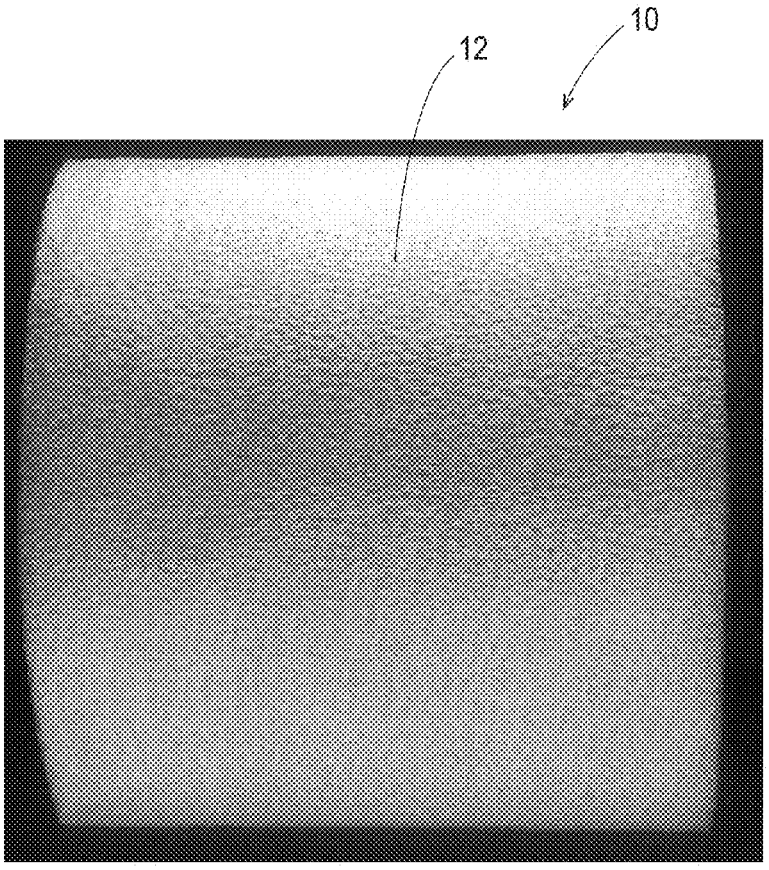
FIG. 2 is a front perspective view of another roll of a fibrous structure in accordance with one non-limiting embodiment.
Figure 3:
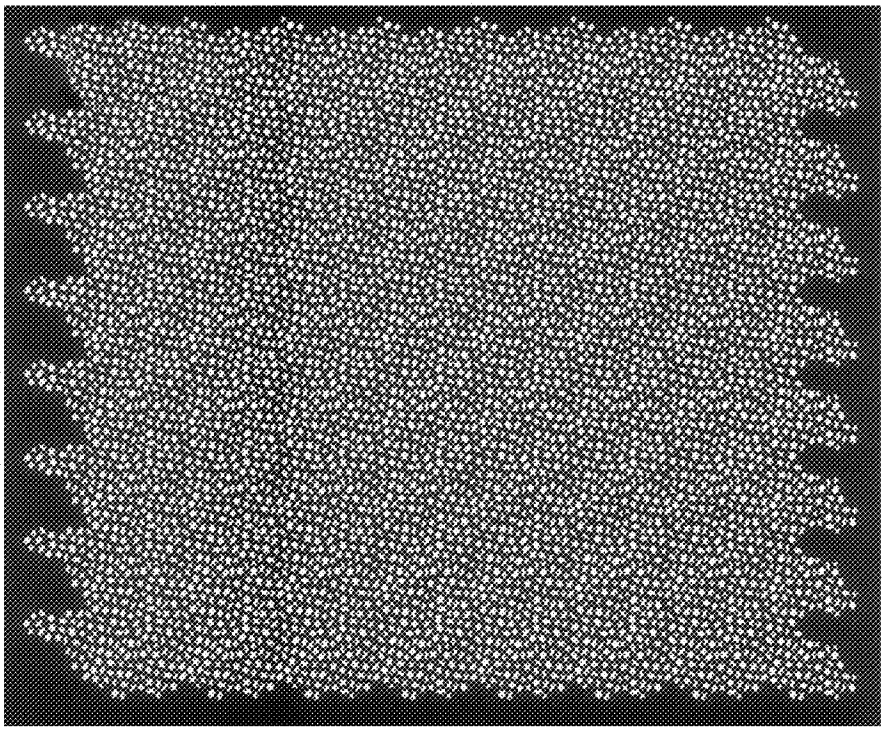
FIG. 3 is an illustration of a portion of a pattern used to make the fibrous structure of FIG. 2 in accordance with one non-limiting embodiment.

In various embodiments, FIGS. 1 and 2, illustrate rolls 10 of fibrous structures having a pattern of discrete elements 12. The fibrous structures shown in FIGS. 1 and 2 are bath tissue, and the discrete elements 12 shown were wet formed during the papermaking process. The pattern of discrete elements shown in FIG. 1 is inverse to the pattern shown in FIG. 2. Stated another way, the pattern of FIG. 1 has relatively low density areas where relatively high density areas are in FIG. 2 and, similarly, the pattern of FIG. 1 has relatively high density areas where relatively low density areas are in FIG. 2. The fibrous structure of FIGS. 1 and 2 can be wet formed using a papermaking belt having the patterns shown in FIGS. 1A and 3, respectively. Any portion of the patterns of FIGS. 1A and 3 that is white represents a raised portion of the papermaking belt, and each forms a relatively high density area in a fibrous structure, while any portion of the patterns of FIGS. 1A and 3 that is black represents a deflection conduit of the papermaking belt, and each forms a relatively low density area in the fibrous structure. This inverse relation (black/white) can apply to all patterns of the present disclosure, although all fibrous structures/patterns of each category are not illustrated for brevity since the concept is illustrated in FIGS. 1-3. The white portions of FIG. 1A are substantially continuous member extending from a reinforcing element on a papermaking belt which member defines a plurality of discrete deflection cells (represented as the discrete black elements in FIG. 1A). The white portions of FIG. 3 are discrete raised portions extending from a reinforcing element on a papermaking belt which portions define a substantially continuous deflection conduit (represented as the black portion of FIG. 3). The papermaking belts of the present disclosure and the process of making them are described in further detail below.

FIG. 1 illustrates a roll 10 of a fibrous structure having a continuous or substantially continuous relatively high density network at least partially or fully defining or surrounding a plurality of relatively low density discrete elements situated in an irregular pattern. The continuous or substantially continuous relatively high density network can be said to form a continuous or substantially continuous "knuckle" regions in the fibrous structure, while the relatively low density discrete elements can be said to form "pillow" regions in the fibrous structure. In an embodiment, the roll 10 can exhibit a substantially continuous relatively high density network at least partially defining a plurality of relatively low density, irregularly shaped, discrete elements situated in a uniform pattern.

FIG. 2 illustrates a roll 10 of a fibrous structure having a continuous or substantially continuous relatively low density network at least partially or fully defining or surrounding a plurality of relatively high density discrete elements situated in an irregular pattern. The continuous or substantially continuous relatively low density network can be said to form a continuous or substantially continuous "pillow" regions in the fibrous structure, while the relatively high density discrete elements can be said to form "knuckle" regions in the fibrous structure. In an embodiment, the roll 10 can exhibit a substantially continuous relatively low density network at least partially defining a plurality of relatively high density, irregularly shaped, discrete elements situated in a uniform pattern.

The patterns of FIGS. 1A and 3, described above as representing elements of a papermaking belt, can also represent the pattern of a mask used to for making the papermaking belt. That is, the patterns shown can be printed on a transparent or semi-transparent film that can be used as a mask to selectively cure resin on a papermaking belt. The black portions correspond to printed portions of a mask, which block curing radiation, thereby creating a plurality of discrete deflection cells or one or more continuous or substantially continuous deflection conduits (i.e., no resin or other material extending from a reinforcing member) in a papermaking belt. The white portions (transparent, non-printed portions) create a plurality of discrete raised portions or one or more continuous or substantially continuous members (i.e., resin or other material extending from a reinforcing member) on the papermaking belt. In essence, the film is positioned over a layer of photocurable resin or other material situated on a reinforcing element, such as a wire mesh. A light source is then projected onto the film. The light source passes through portions of the film in the white areas and does not pass through the film in the black areas. The light source that passes through the white areas at least partially cures (i.e., hardens) the resin under the white portions in the film, while the resin under the black portions remains uncured or at least mostly uncured since no light passed to that portion of the resin. The uncured resin (under the black portions) is then washed off of the reinforcing element of the papermaking belt, thereby leaving behind a plurality of discrete deflection cells or one or more continuous or substantially continuous deflection conduits (no resin) and one or more continuous or substantially continuous members or a plurality of discrete raised portions, depending on the positioning of the black portion/white portion.

When a fibrous slurry is deposited onto the papermaking belt, a three-dimensional fibrous structure is formed. To dry the fibrous structure, the fibrous structure can be fed onto a Yankee dryer and then creped (or removed from the Yankee dryer) with a doctor blade. The resulting fibrous structure can have areas of relatively high density (where the resin deposits were present on the reinforcing element) and areas of relatively low density (where the resin deposits were not present on the reinforcing element). This fibrous structure-making process is described in greater detail below, but is discussed here to set forth the general process for clarity in illustration.

Figure 4A:
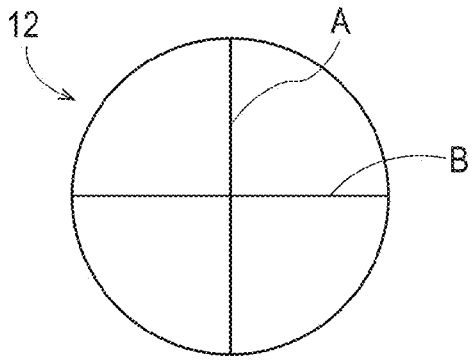
FIGS. 4A and 4B are top views of individual discrete elements in accordance with various non-limiting embodiments.
Figure 4B:
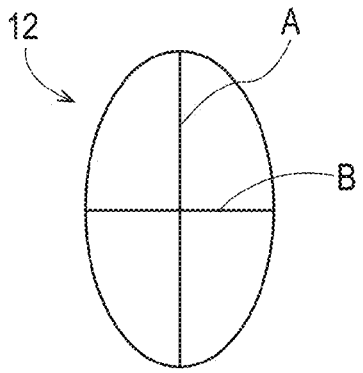
Figure 5A:
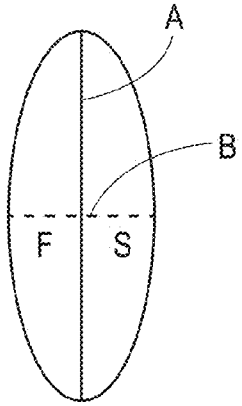
FIGS. 5A-5D are top views of individual discrete elements in accordance with various non-limiting embodiments.
Figure 5B:
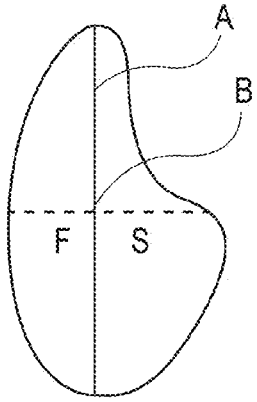
Figure 5C:
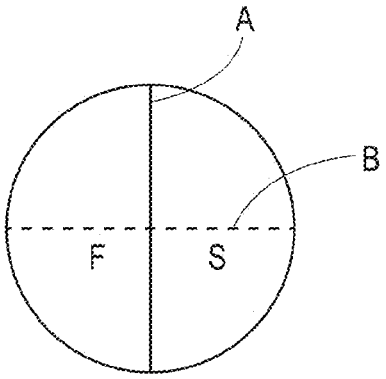
Figure 5D:
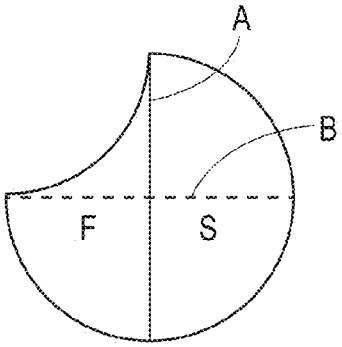

In one embodiment, referring to FIGS. 4A and 4B, each individual discrete element 10 of a fibrous structure (schematically illustrated without the fibrous structure for clarity), whether that discrete element 10 has a relatively high density or a relatively low density can have a major axis, A, and a minor axis, B. The ratio of the length major axis, A, to the length of the minor axis, B, can be greater than (FIG. 4B) or equal to (FIG. 4A) one. Stated another way, the major axis, A, can be longer than or can have the same length as the minor axis, B. In one embodiment, the ratio of the length of the major axis, A, to the length of the minor axis, B, can be in the range of 1 to about 3 or in the range of 1 to about 4 or more. For example, the ratio of the length of the major axis, A, to the length of the minor axis, B, can be 1, 1.5, 2, 2.5, 3, 3.5, 4, 4.5, or 5. Measuring the length of axes can be accomplished via direct measurement, via microscopic analysis, by measuring to a portion of the discrete element in which a 3D elevation change occurs. If a precise measurement on a fibrous structure cannot be accomplished, the axes dimensions can be considered to be the axes dimensions of the wet-forming or dry-forming element used to produce the discrete elements.

In one embodiment, referring to FIGS. 5A-5D, each individual discrete element 10 of a fibrous structure, whether that discrete element 10 has a relatively high density or a relatively low density can exhibit an irregular shape. A discrete element can be divided into a first portion, F, and a second portion, S, by the major axis, A. In various embodiments, the first portion, F, can have the same area (FIGS. 5A and 5C) or a different area (FIGS. 5B and 5D) than the second portion, S. In various embodiments, the first portion, F, can be symmetrical (FIGS. 5A and 5C) to the second portion, S, or can be asymmetrical (FIGS. 5B and 5D) to the second portion, S. In one embodiment, the first portion, F, can have the same shape (FIGS. 5A and 5B) as the second portion, S, or can have a different shape (FIGS. 5B and 5D) as the second portion, S. In general, the discrete elements 10 can have at least one arcuate portion on a portion of their perimeter. The discrete elements 10 can have the same characteristics if they are instead divided about their minor axis, B (illustrated in dash).

Figure 6:
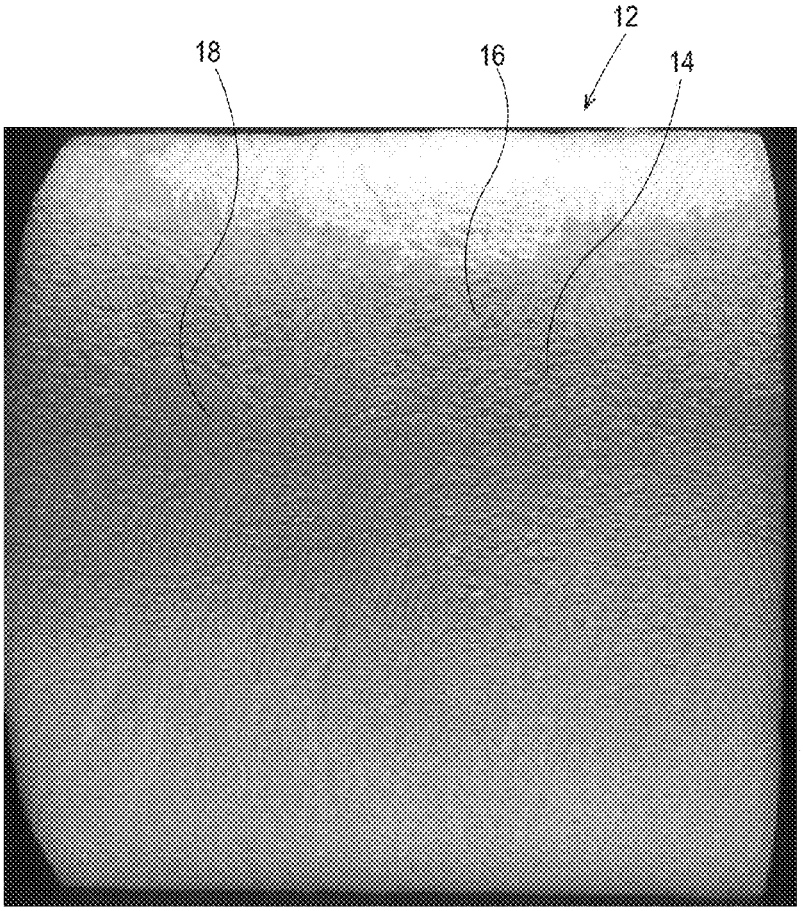
FIG. 6 is a front perspective view of another roll of a fibrous structure in accordance with one non-limiting embodiment.

In one embodiment, referring to FIG. 6, a roll 10 of a fibrous structure is illustrated. The fibrous structure comprises a substantially continuous relatively low density network 14 extending at least partially or fully about an area of the fibrous structure. The substantially continuous relatively low density network 14 at least partially or fully defines or surrounds a plurality of relatively high density discrete elements 16 situated in an irregular pattern. Although illustrated as such, it will be understood that the fibrous structure could be the inverse (i.e., a substantially continuous relatively high density network extending at least partially or fully about an area of the fibrous structure, wherein the substantially continuous relatively high density network at least partially or fully defines or forms a plurality of relatively low density discrete elements situated in an irregular pattern, much like the fibrous structure illustrated in FIG. 2. The substantially continuous relatively low density network of FIG. 6 and the plurality of relatively high density discrete elements situated in an irregular pattern together can form a background pattern in the fibrous structure. A macro pattern 18 (flower and stems in this example) can also be formed in the fibrous structure. In one embodiment, the background pattern will not be present in areas encompassed by the macro pattern. In other embodiments, the background pattern can be present in at least some areas encompassed by the macro pattern. In one embodiment, the macro pattern can comprise alternating relatively low density regions and relatively high density regions within or inside its perimeter, including generally parallel relatively high density regions, each separated by relatively low density regions, as depicted in FIG. 6. In one embodiment, the macro pattern can comprise first and second relatively low density regions and first and second discrete relatively high density regions. The first and second relatively low density regions can be connected or joined to a substantially continuous relatively low density network or can be discrete as well.

Figure 7:
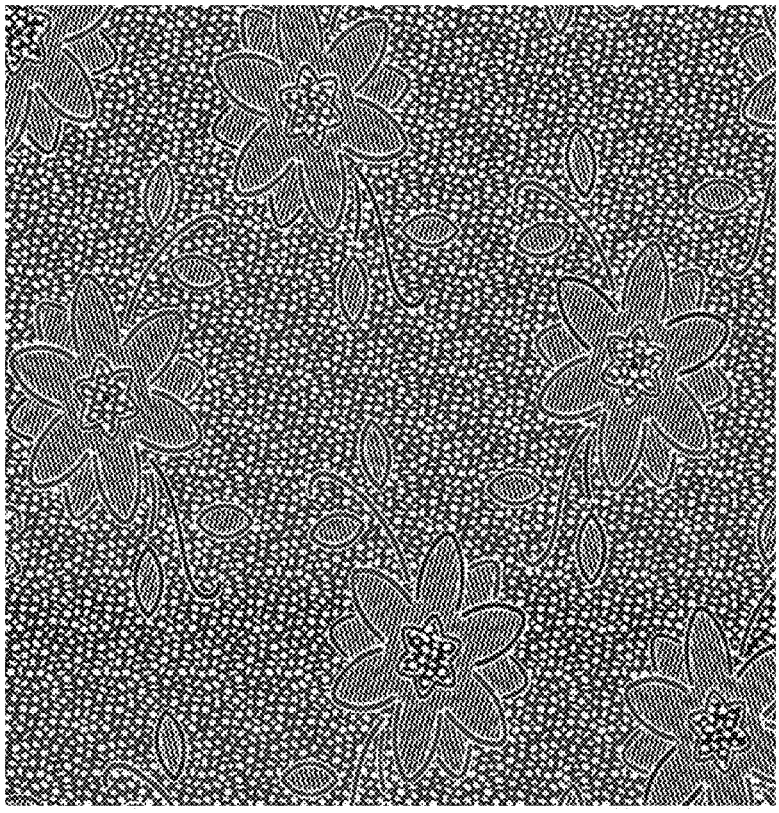
FIG. 7 is an illustration of a portion of a pattern used to make the fibrous structure of FIG. 6 in accordance with one non-limiting embodiment.

The pattern on a film as depicted in FIG. 7 can be used to form a papermaking belt that can produce the fibrous structure of FIG. 6, once creped by a doctor blade to eliminate the elongation of the flower macro pattern illustrated in FIG. 7. In the film pattern of FIG. 7, white portions represent transparent portion of the film that will allow radiation (e.g., UV) curing of resin on a papermaking belt to produce discrete raised portions, while black portions represent opaque portions of the film that block radiation (e.g., UV) curing to produce void areas or one or more substantially continuous deflection conduits on the papermaking belt. The substantially continuous deflection conduits can at least partially define or surround the discrete raised portions on the papermaking belt. The pattern of FIG. 7 can also be inverted (i.e., white portions become black portions and black portions become white portions) to produce a papermaking belt where discrete deflection cells (no resin or other material) are formed in areas under the black portions and a substantially continuous member (resin or other material) is formed in areas under the white portions. The discrete deflection cells can be situated in an irregular pattern and can be at least partially defined or surrounded by the substantially continuous member. Although a particular linear pattern of alternating relatively low and high density regions are illustrated within the macro pattern of FIG. 7, it will be understood that any other suitable pattern of alternating relatively low and high density regions, or any other non-alternating pattern can be used within the macro pattern. In one embodiment, the macro pattern may not be provided.

Figure 8:
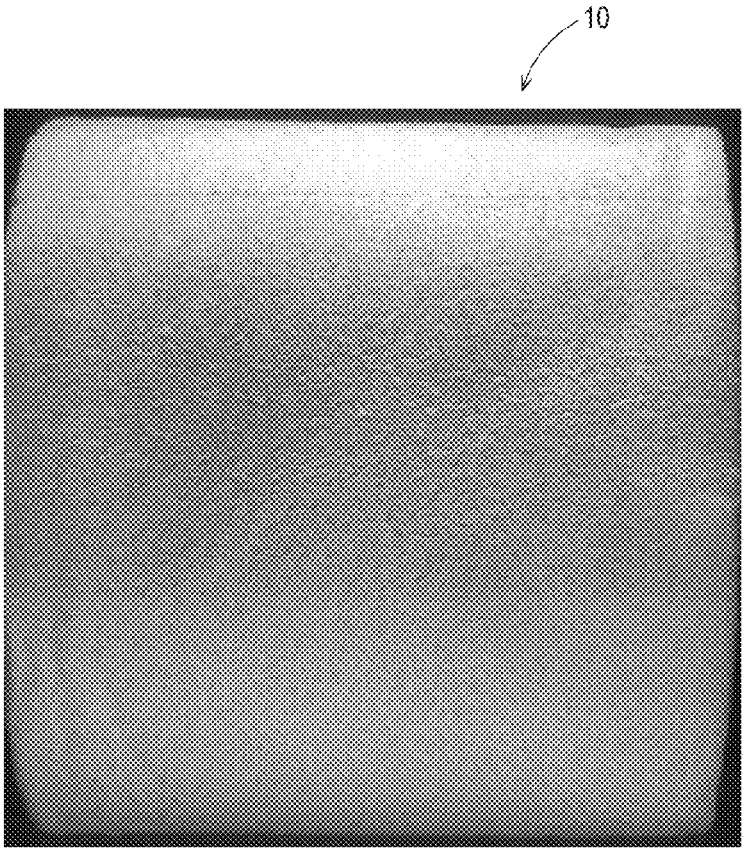
FIG. 8 is a front perspective view of another roll of a fibrous structure in accordance with one non-limiting embodiment.
Figure 9:
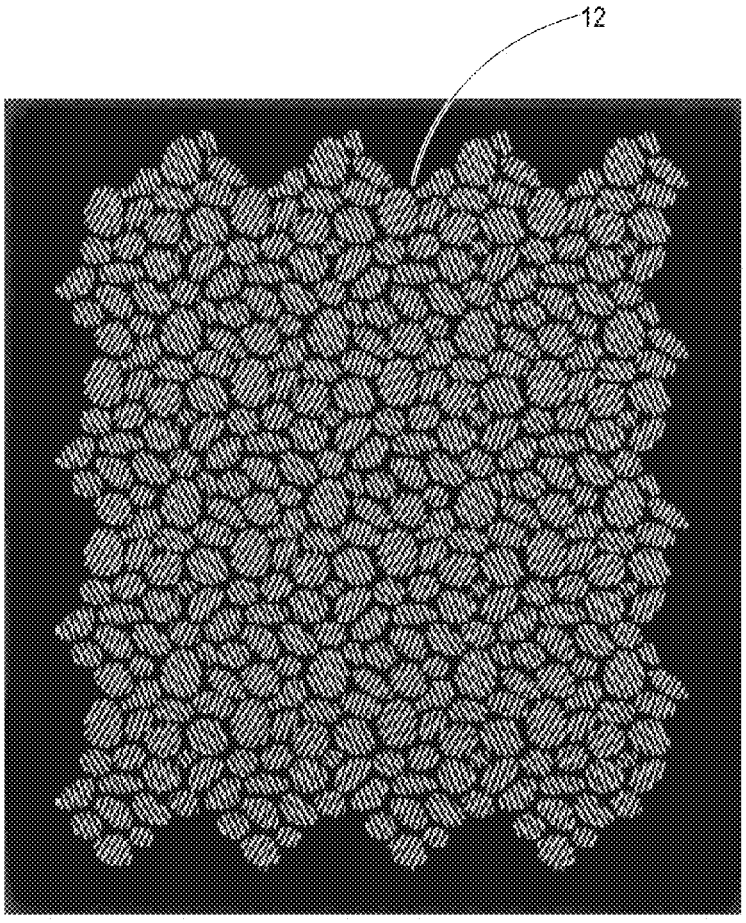
FIG. 9 is an illustration of a portion of a pattern used to make the fibrous structure of FIG. 8 in accordance with one non-limiting embodiment.

In one embodiment, referring to FIG. 8, a roll of a fibrous structure is illustrated. FIG. 9 illustrates a pattern on a film used to create a papermaking belt that can form the fibrous structure of FIG. 8. The black portions on the film of FIG. 9 form one or more continuous or substantially continuous deflection conduits (resin not present) on a reinforcing element of a papermaking belt, while the white portions of the film form discrete raised portions (e.g., resin) extending from the reinforcing element of the papermaking belt. As can be seen from FIG. 8, a continuous or substantially continuous relatively low density network can extend about an area or all of the fibrous structure. The continuous or substantially continuous relatively low density network can at least partially or fully define or surround a plurality of discrete elements 12 situated in an irregular pattern, wherein each of the discrete elements 12 can each exhibit a pattern of parallel ribs formed by the relatively low density network. Within a discrete element 12 the ribs can be parallel in a regular repeating pattern, each rib oriented in the same direction, while for a collection of discrete elements 12, each discrete element 12 can exhibit parallel ribs having a different orientation relative to adjacent discrete elements (as depicted in FIGS. 8 and 9).

Figure 10:
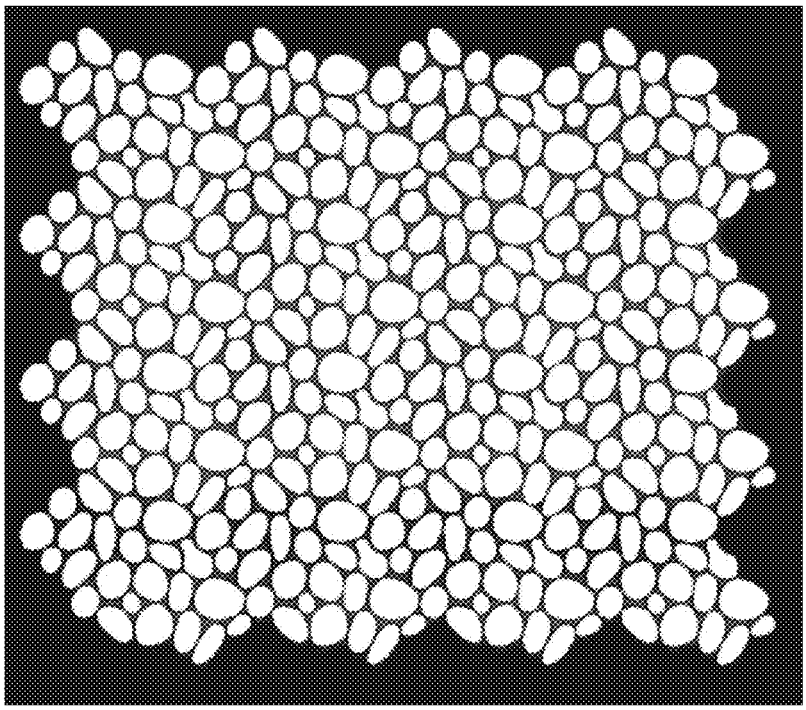
FIG. 10 is an illustration of a portion of a pattern used to make fibrous structures in accordance with one non-limiting embodiment.

Referring to FIG. 10, a pattern on a film can be used to create a papermaking belt comprising a plurality of discrete raised portions (white portions on film) surrounded by a continuous or substantially continuous deflection conduit (black portions on film). The discrete raised portions can form relatively high density discrete elements situated in an irregular pattern in a fibrous structure. The relatively high density discrete elements can be at least partially defined or surrounded by a relatively low density continuous network in the fibrous structure. In various embodiments, the discrete elements may or may not have a pattern formed therein. Referring again to FIGS. 8 and 9, a plurality of discrete element having a pattern formed therein is illustrated. In one embodiment, the pattern can comprise alternating relatively low and high density regions or other non-alternating patterns (e.g., the ribs described above). The regions can be linear (as illustrated) or non-linear (not illustrated). In other embodiments, the regions can form any other suitable shapes, such as circles, for example. In one embodiment, as best seen in FIG. 9 (although shown on the film), the relatively low density regions within the discrete elements in the fibrous structure can be in contact with the continuous or substantially continuous low density network.

Similar to the discrete elements illustrated in FIGS. 5A-5D, each of the discrete elements in FIGS. 8-10, whether that discrete element has a relatively high density, a relatively low density, and/or alternative regions of relatively high and low density can be divided into a first portion, F, and a second portion, S, by the major axis, A. In various embodiments, the first portion, F, can have the same area or a different area than the second portion, S. In one embodiments, the first portion, F, can be symmetrical to the second portion, S, or can be asymmetrical to the second portion, S. The first portion, F, can also have the same or a different shape as the second portion, S. The discrete elements can have the same characteristics if they are instead divided about their minor axis, B.

Figure 11:
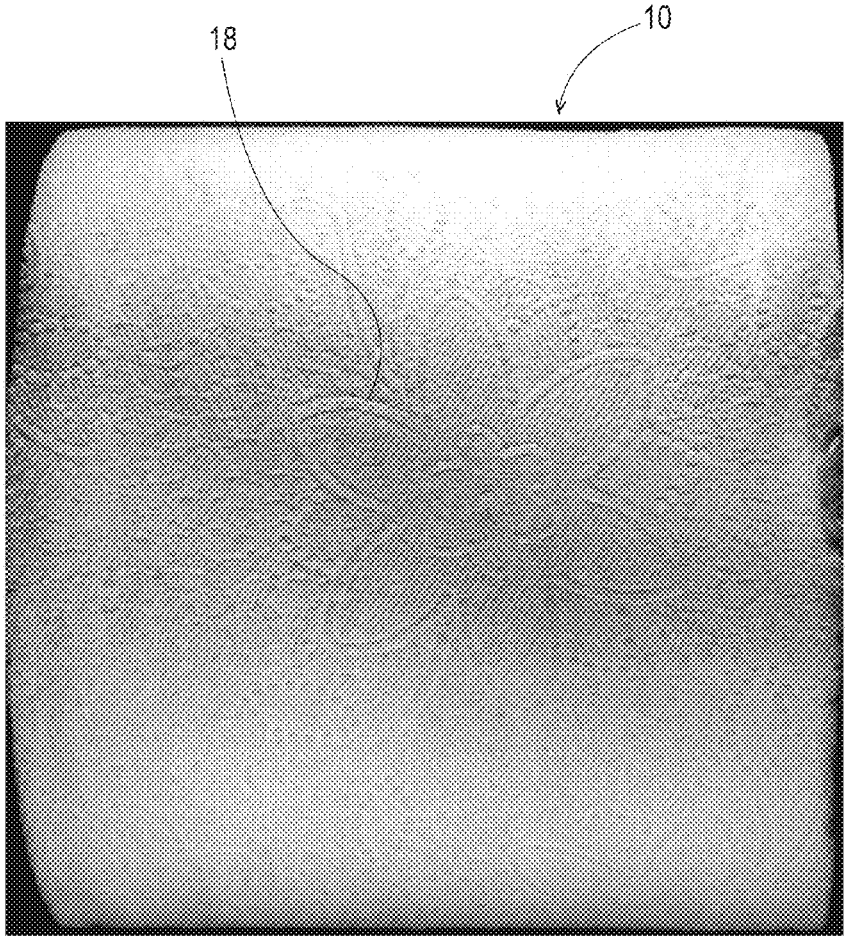
FIG. 11 is a front perspective view of another roll of a fibrous structure in accordance with one non-limiting embodiment.

In one embodiment, referring to FIG. 11, a fibrous structure is illustrated with a substantially continuous relatively low density network extending about an area or all of the fibrous structure. The substantially continuous relatively low density network can at least partially define, form, and/or surround a plurality of discrete elements situated in an irregular pattern, thereby forming a background pattern in the fibrous structure. Each discrete element can have alternating relatively high and low density parallel rib regions formed therein or can be formed of a relatively high density area (not illustrated). The pattern shown on the film of FIG. 12 can be used to form the fibrous structure of FIG. 11, as described herein above. Each of the relatively high or low density regions within each discrete element can comprise a first end and a second end. A macro pattern 18 is also formed in the fibrous structure of FIG. 11. The macro pattern 18 may not comprise the background pattern therein. The macro pattern 18 can comprise parallel ribs of alternating relatively low density regions and relatively high density regions therein. The regions can each comprise a first end and second end. A second axis can be defined intermediate the first end and the second end of the regions. The second axis can extend in a second direction and can have a positive or a negative slope. The first direction of the first axes of the regions within each discrete element can be different than or the same as the second direction of the second axis of the regions within the macro pattern. In one embodiment, the first axis can be transverse to, parallel to, or perpendicular to the second axis. In various embodiments, the regions within each discrete element can be linear or non-linear and the region within the macro pattern can be linear or non-linear. The patterns of alternating relatively high and low density regions within a particular discrete element can be different or the same as the patterns within another discrete element. Alternating relatively high and low density regions with a particular macro pattern in the fibrous structure can the same as or different from the patterns within another macro pattern in the fibrous structure. In various embodiments, the patterns of alternatively relatively high and low density regions within each discrete element or each macro pattern can be different or the same.

Each fibrous structure having the discrete elements described herein, whether the discrete elements are relatively low density, relatively high density, or have alternating regions of relatively high and low density can form an irregular pattern. The discrete elements forming the irregular pattern can have two, three or more, 24 or more, 90, or 2 to 90 different shapes, specifically reciting each whole integer within the above-specified range. At least two of the discrete elements can have different areas. By providing discrete elements with different areas and shapes, the irregular pattern can be formed in fibrous structures. In one embodiment, each discrete element can have an arcuate portion forming a portion of its perimeter.

Figure 12:
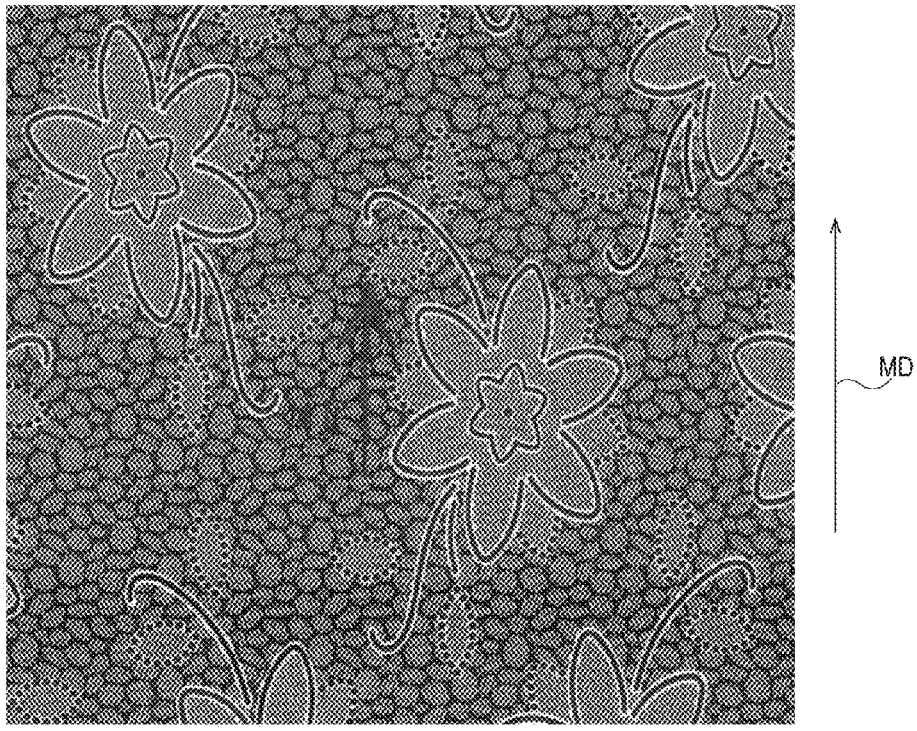
FIG. 12 is an illustration of a portion of a pattern used to make the fibrous structure of FIG. 11 in accordance with one non-limiting embodiment.
Figure 13:
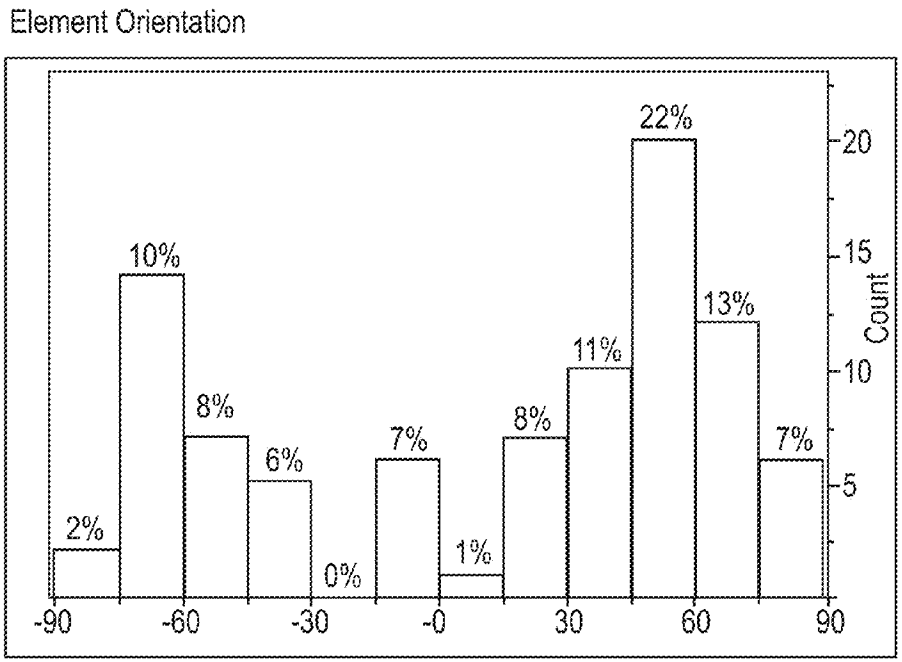
FIG. 13 is a graph of a bi-modal distribution in accordance with one non-limiting embodiment.
Figure 13A:
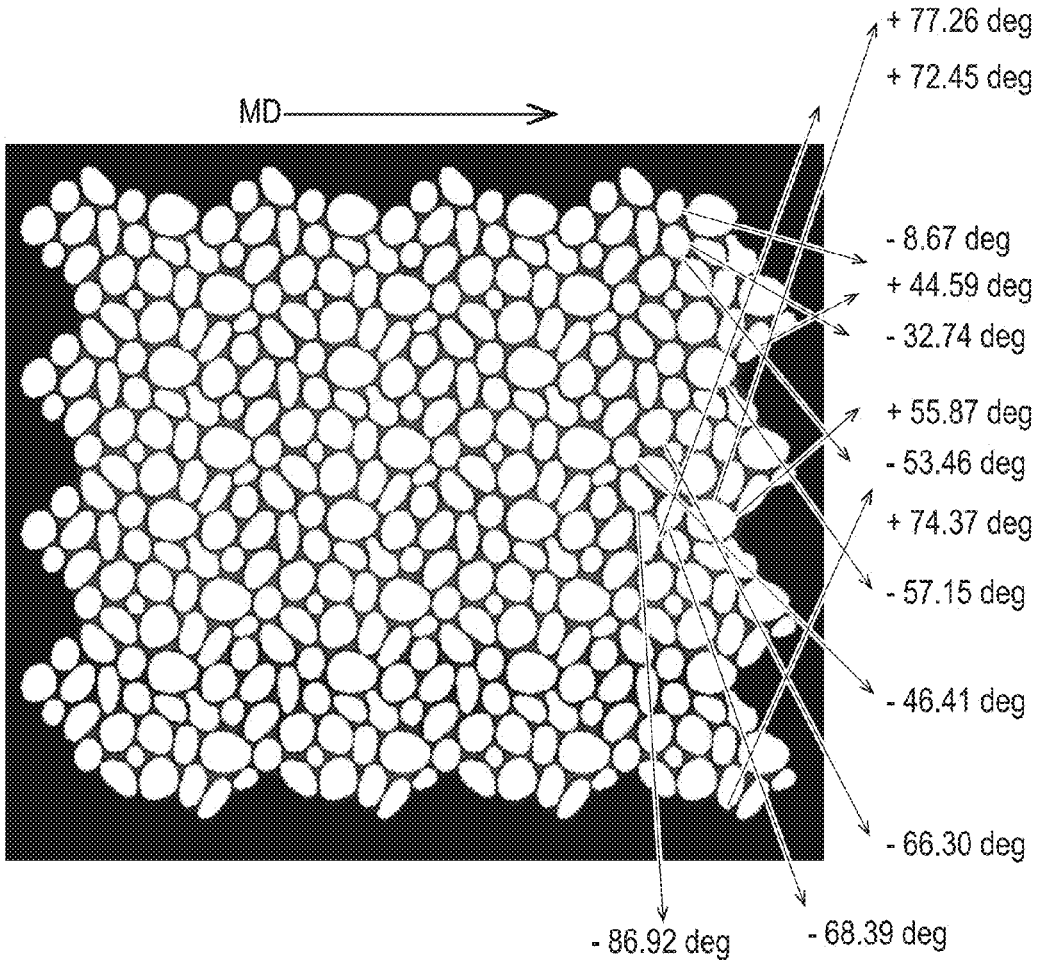
FIG. 13A is an example of angles of major axes of discrete elements relative to the machine direction in accordance with one non-limiting embodiment.
Figure 14:
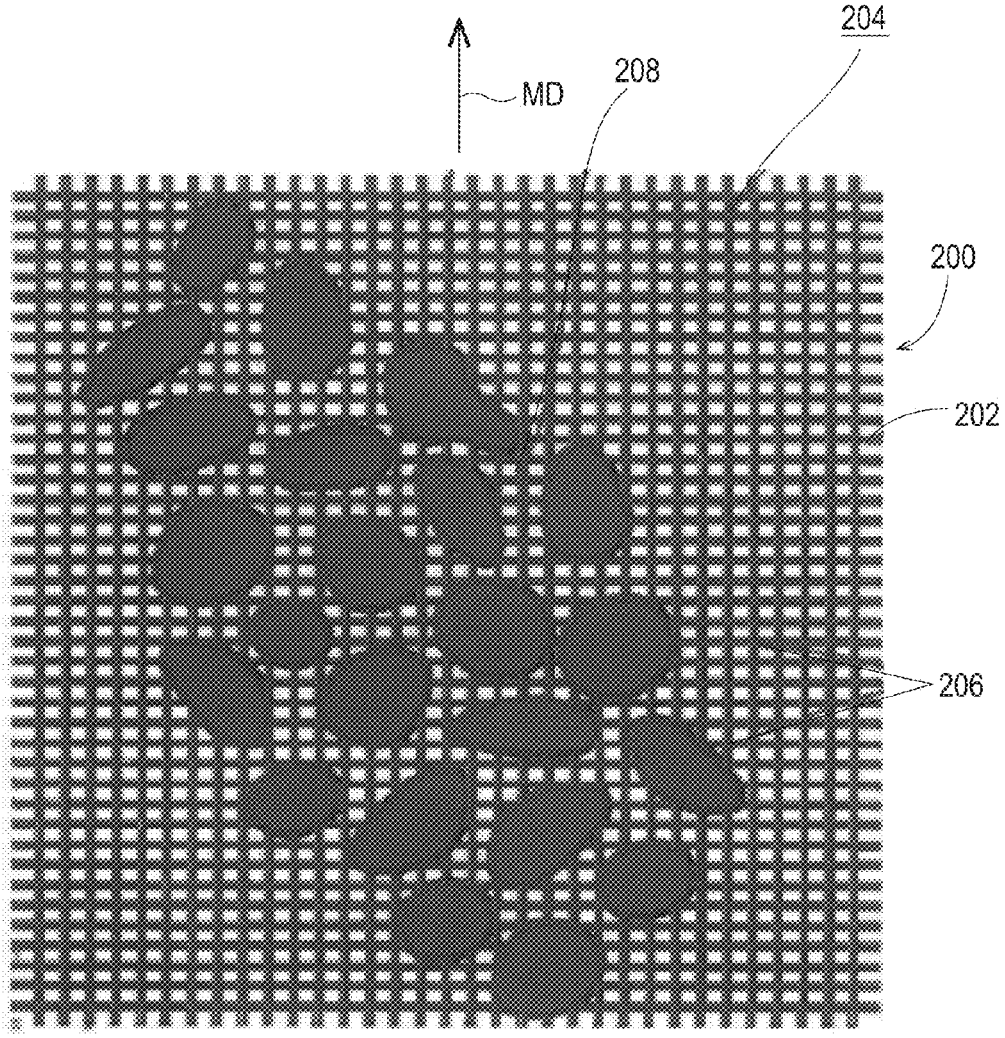
FIG. 14 is a top view of a portion of a papermaking belt used to produce some of the fibrous structures of the present disclosure in accordance with one non-limiting embodiment.

In one embodiment, referring to FIG. 13A, each major axis of each discrete element described herein in a fibrous structure can extend in a direction in the range of −90 degrees to 90 degrees relative to a machine direction of 0 degrees. The machine direction corresponding to an orientation of 0 degrees is illustrated in FIGS. 12, 13A, and 14, as an example. The distribution of the number of discrete elements having an angle of its major axis, relative to the machine direction, falling within a certain range is illustrated in FIG. 13. Example angles of major axes of certain discrete elements, relative to the machine direction MD are illustrated in FIG. 13A. As can be seen from FIG. 13, no discrete elements or 0 percent of the discrete elements of the fibrous structures fall within the range of −30 degrees to −15 degrees, as one example. Other examples can have a gap within another range of angles depending on the orientation, shape, and size of the discrete elements of a particular fibrous structure. The graph of FIG. 13 illustrates one example of the bi-modal distribution of the angles of the major axes of the discrete elements in a fibrous structure of a relative to a machine direction of 0 degrees, between −90 and 90 degrees. As can be seen in FIG. 13, 2 percent of the angles fall within the range of −90 to −75 degrees, 16 percent of the angles fall within the range of −75 to −60 degrees, 8 percent of the angles fall within the range of −60 to −45 degrees, six percent of the angles fall within the range of −45 to −30 degrees, zero percent of the angles fall within the range of −30 to −15 degrees, 7 percent of the angles fall within the range of −15 to 0 degrees, 1 percent of the angles fall within the range of 0 to 15 degrees, 8 percent of the angles fall within the range of 15 to 30 degrees, 11 percent of the angles fall within the range of 30 to 45 degrees, 22 percent of the angles fall within the range of 45 to 60 degrees, 13 percent of the angles fall within the range of 60 to 75 degrees, and 7 percent of the angles fall within the range of 75 to 90 degrees. The maximum angle of this data set was 80.3057 degrees, while the minimum angle of this data set was −89.931 degrees. The median angle of this data set was 37.7022 degrees. To the inventor's knowledge, no other fibrous structures exist with discrete elements having major axes having a bi-modal distribution.

In one embodiment, instead of the continuous or substantially continuous network and discrete elements being formed into a fibrous structure during the papermaking process, they can instead be formed by embossing after the papermaking process during a process known as converting. An embossing roll can have a plurality of discrete elements extending radially outwardly from a surface thereof. The plurality of discrete elements can be formed in an irregular pattern having a bi-modal distribution. As such, the discrete elements can be compressed into the fibrous structure by the embossing roll to form relatively high density discrete elements in a fibrous structure while leaving uncompressed, or substantially uncompressed, the relatively low density continuous or substantially continuous network at least partially defining or surrounding the relatively high density discrete elements. In another embodiment, the embossing roll can have a continuous or substantially continuous network extending radially outwardly from a surface thereof. The continuous or substantially continuous network can define or surround a plurality of discrete elements situated in an irregular pattern. The continuous or substantially continuous network can be compressed into the fibrous structure through embossing, thereby creating a continuous or substantially continuous relatively high density network at least partially defining or surrounding a plurality of uncompressed, or substantially uncompressed, relatively low density discrete elements situated in an irregular pattern in the fibrous structure. The irregular pattern can have a bi-modal distribution. In various embodiments, such embossing rolls can be configured to also emboss macro patterns into the fibrous structures.

In various embodiments, the macro patterns described herein can also be embossed into the fibrous structure. An embossing roll can have portions of the macro pattern extending radially outwardly therefrom so that when the fibrous structure is contacted by such portions of the embossing roll, portions of the fibrous structure can be compressed thereby forming relatively high density areas in the fibrous structure. The uncompressed, or substantially uncompressed, areas can form the remainder of the macro pattern (i.e., relatively low density areas in the fibrous structure). In various embodiments, embossing rolls can be configured to also emboss one or more macro patterns into fibrous structures.

In various embodiments, the fibrous structures of the present disclosure can comprise one or more free fiber ends. The free fiber ends can be formed on the continuous or substantially continuous network, formed in the discrete elements, and/or formed in other areas of a fibrous structure. In one embodiment, more free fiber ends can produce a fibrous structure that has increased softness to a consumer's touch.

Papermaking Belts

Figure 15:
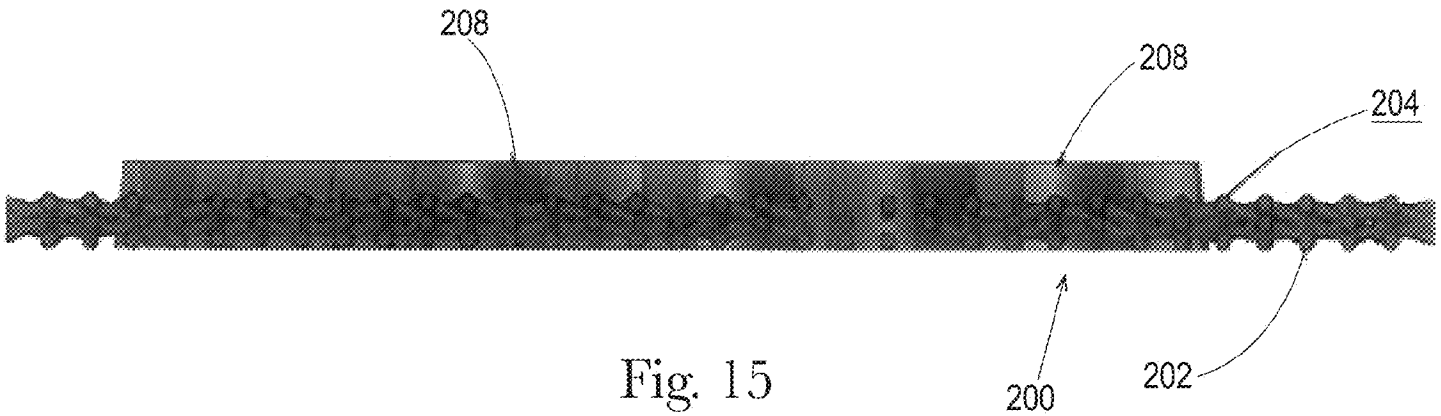
FIG. 15 is a side view of the portion of the papermaking belt of FIG. 14 in accordance with one non-limiting embodiment.
Figure 16:
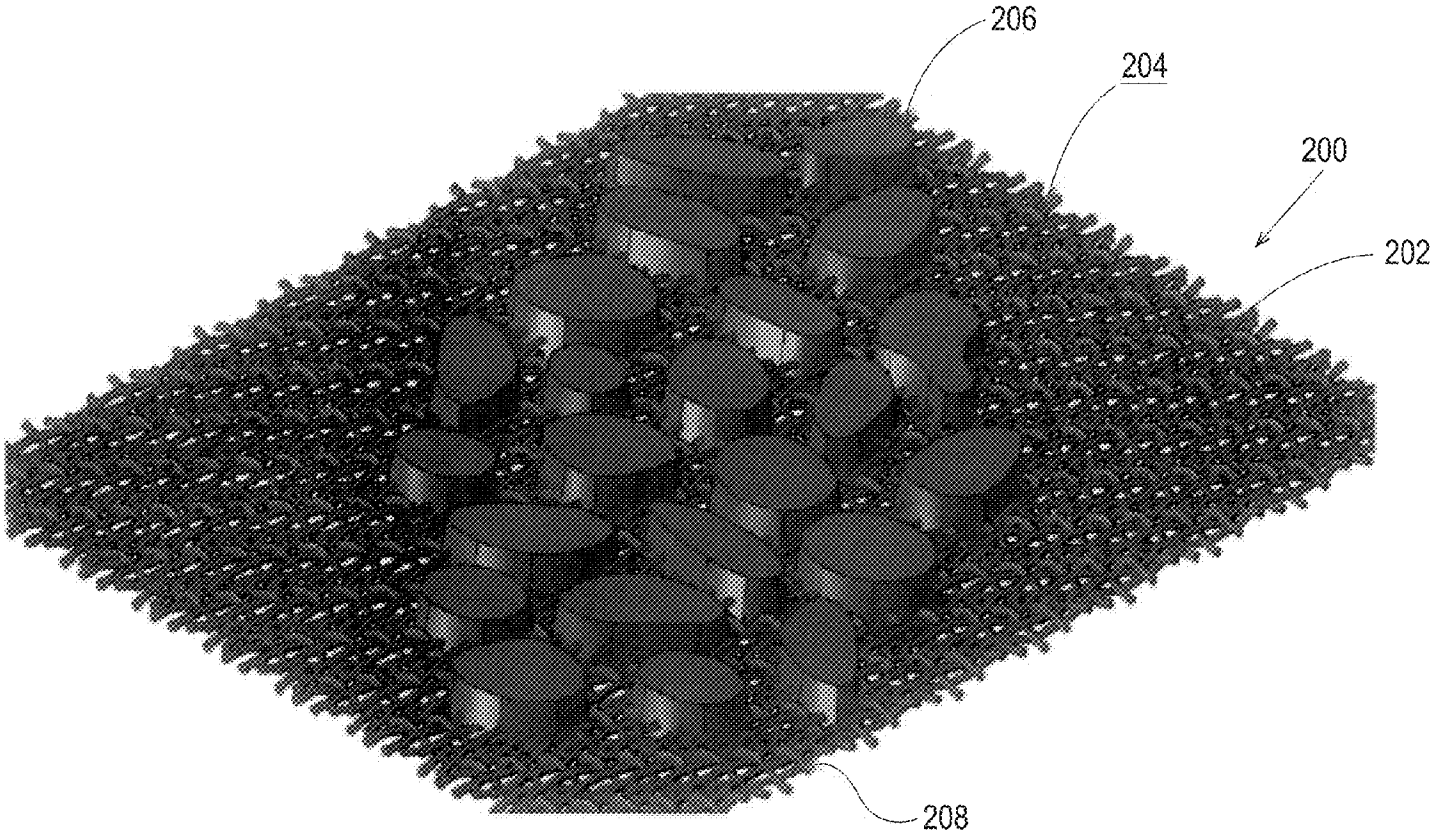
FIG. 16 is a perspective view a portion of the papermaking belt of FIG. 14 in accordance with one non-limiting embodiment.

In one embodiment, referring to FIGS. 14-16, an example portion of a papermaking belt 200 or molding member that can be used to manufacture the fibrous structures of the present disclosure is illustrated. FIG. 14 is a top view of the papermaking belt 200. FIG. 15 is a side view of the papermaking belt 200 of FIG. 14 and FIG. 16 is a perspective view of the papermaking belt 200 of FIG. 14. The papermaking belt 200 can comprise a reinforcing element 202, such as a porous wire mesh, comprising a surface 204. A differently sized reinforcing element is illustrated in FIG. 14 when compared to the reinforcing element 202 of FIGS. 15 and 16, merely to illustrate that different types of reinforcing elements 202 can be used for the papermaking belt 200. A plurality of discrete raised portions 206 can extend from portions of the surface 204 of the reinforcing element 202. The discrete raised portions 206 can be situated or arranged in an irregular pattern. The papermaking belt 200 can further comprise a continuous or substantially continuous deflection 208 conduit at least partially defining or surrounding at least some of or all of the discrete raised portions 206. The relatively high density discrete elements of the fibrous structures described herein can be formed on the discrete raised portions 206 and the substantially continuous relatively low density network of the fibrous structures described herein can be formed on the continuous or substantially continuous deflection conduit 208. The discrete raised portions 206 can correspond to white areas in the patterns on the films described herein, while the continuous or substantially continuous deflection conduit 208 can correspond to black areas in the patterns on the films described herein.

Each of the discrete raised portions 206 can have a major axis, A, and a minor axis, B. The ratio of the length of the major axis, A, to the length of the minor axis, B, can be in the range of 1 to about 3 or in the range of 1 to about 4 or more. For example, the ratio of the lengths of the major axis, A, to the minor axis, B, can be 1, 1.5, 2, 2.5, 3, 3.5, 4, or 4.5. The angles of each major axis, A, relative to a machine direction of 0 degrees (see FIG. 14), of the discrete raised portions 206 can have a bi-modal distribution similar to, or the same as, the discrete elements described herein. The discrete raised portions 206 forming the irregular pattern on the papermaking belt can have 2 or more, 3 or more, 24 or more, 90, or 2 to 90 different shapes (specifically recited any whole integers within the specified ranges), similar to the discrete elements described above. At least two of the discrete raised portions 206 can have different areas or sizes.

In one embodiment, each discrete raised portion 206 can have its major axis, A, extending in a direction (relative to a machine direction). The major axis, A, of a first discrete raised portion 206 can extend in a first direction and the major axis, A, of a second discrete raised portion 206 can extend in a second direction. The first direction can be the same as or different than the second direction. The first major axis, A, can have a positive slope, while the second major axis, A, can have a negative slope. In other embodiments, both of the first and second axes can have a positive or a negative slope.

In various embodiments, referring to FIGS. 19A-19D, each of the discrete raised portions 206 can be divided into a first portion, P1, and a second portion, P2, by the major axis, A. In one embodiment, the area of the first portion, P1, can be the same as (FIGS. 19A and 19C) or different than (FIGS. 19B and 19D) the area of the second portion, P2. In various embodiments, the shape of the first portion, P1, can be symmetrical to (FIGS. 19A and 19C) the shape of the second portion, P2, or the shape of the first portion, P1, can be asymmetrical to (FIGS. 19B and 19D) the shape of the second portion, P2. Symmetry is be viewed with respect to the major axis, A. In various embodiments, the size of the first portion, P1, can be the same as or different than the size of the second portion, P2. In other embodiments, symmetry can also be evaluated about the minor axis, B (not illustrates in FIGS. 19A-19D).

Figure 17:
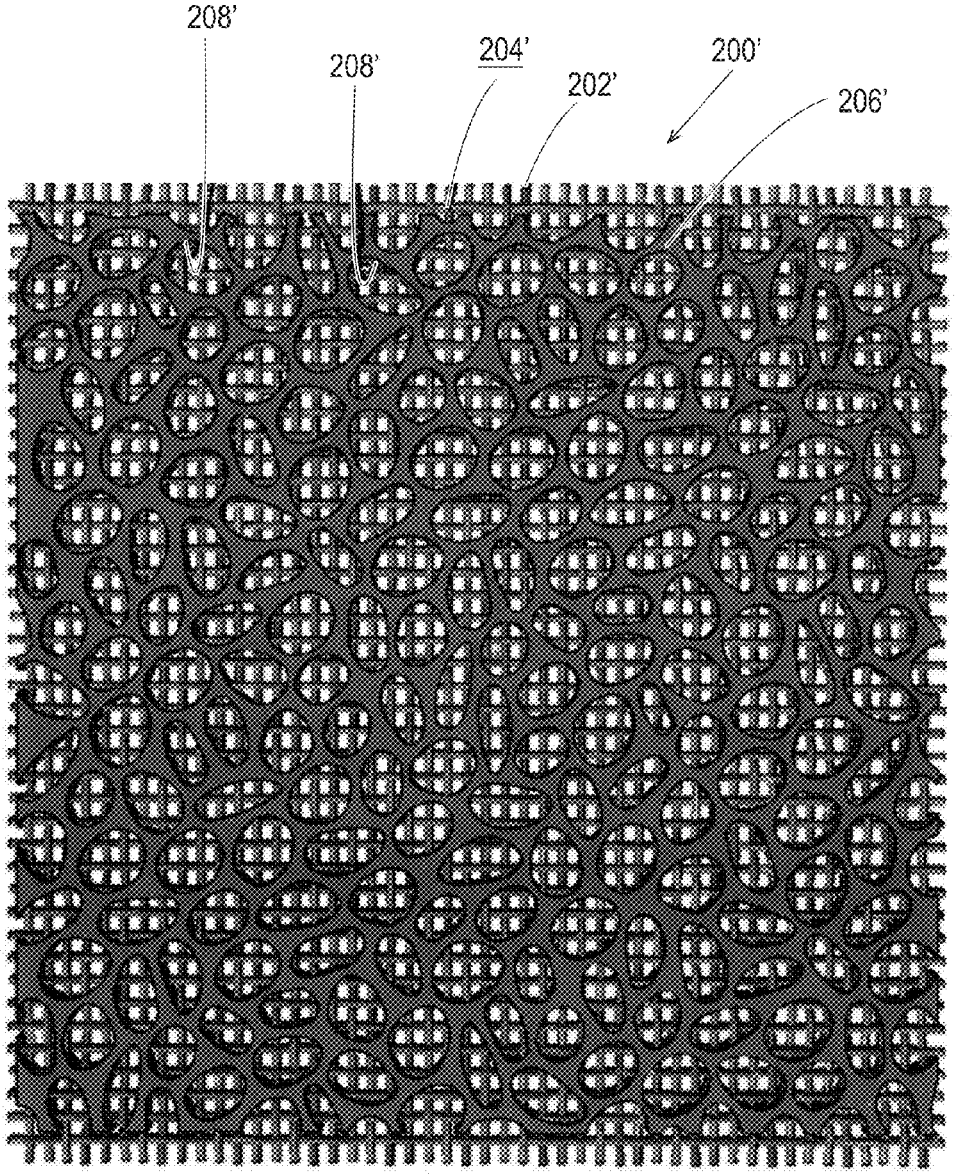
FIG. 17 is a top view of a portion of a papermaking belt used to produce some of the fibrous structures of the present disclosure in accordance with one non-limiting embodiment.
Figure 18:
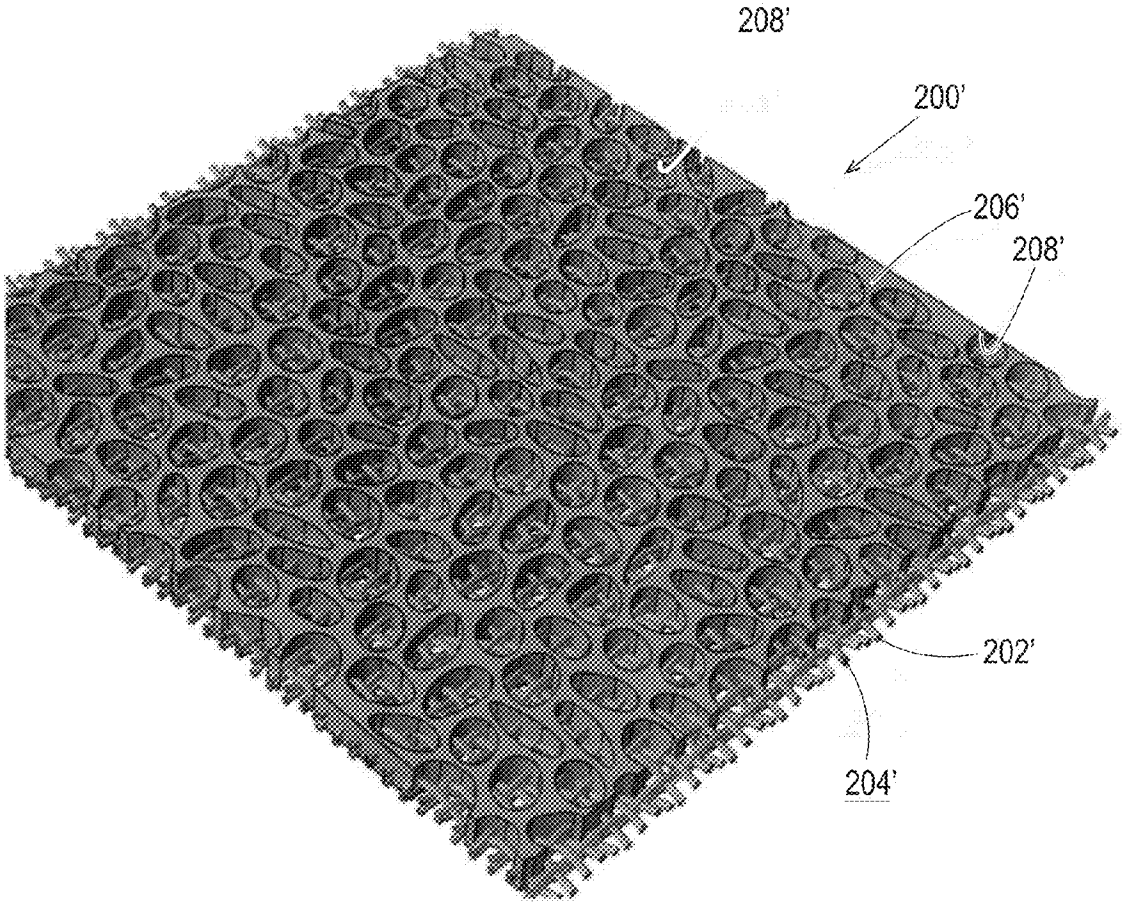
FIG. 18 is a perspective view a portion of the papermaking belt of FIG. 17 in accordance with one non-limiting embodiment.
Figure 19A:
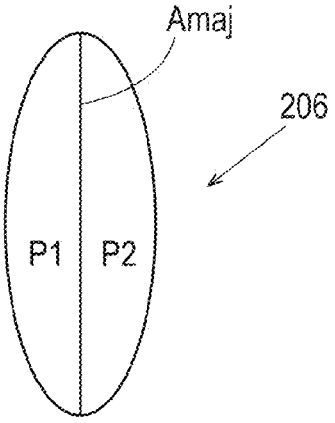
FIGS. 19A-19D are top views of individual discrete raised portions in accordance with various non-limiting embodiments.
Figure 19B:
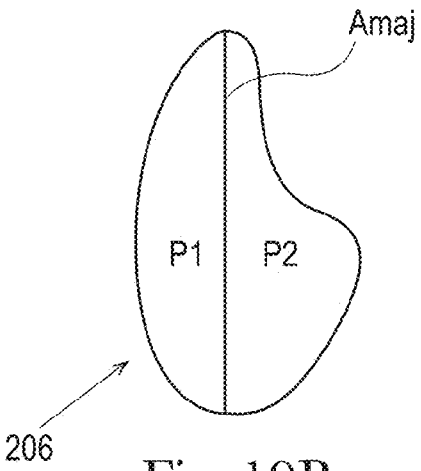
Figure 19C:
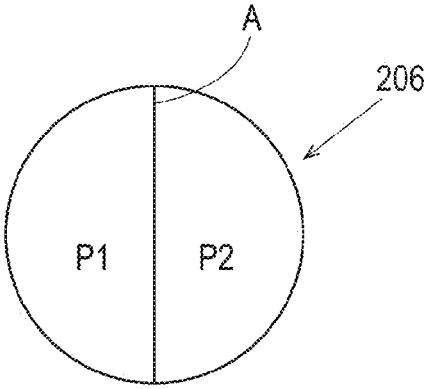
Figure 19D:
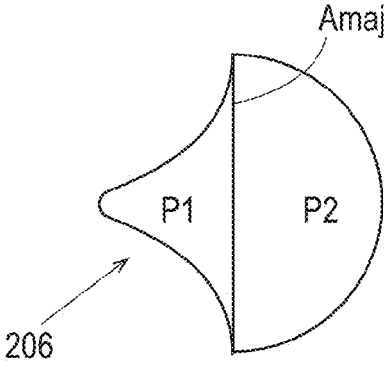

Although the papermaking belt 200 is illustrated with discrete raised portions 206 in FIGS. 14-16, an inverse papermaking belt 200' is also within the scope of the present disclosure and is illustrated in an example embodiment in FIGS. 17 and 18. In such an embodiment, the papermaking belt can comprise a reinforcing element 202' comprising a surface 204', a continuous or substantially continuous member 206' extending from portions of the surface 204' of the reinforcing element 202', and a plurality of discrete deflection cells 208' at least partially defined or surrounded by the continuous or substantially continuous member 206'. The plurality of discrete deflection cells 208' can be defined in an irregular pattern. Each of the discrete deflection cells 208' can have a major axis, A, and a minor axis, B, wherein the ratio of the length of the major axis, A, to the length of the minor axis, B, can be equal to or greater than one. In one embodiment, the ratio of the length of the major axis, A, to the length of the minor axis, B, is in the range of 1 to about 3 or in the range of 1 to about 4 or more. The angles of the major axes, A, of the discrete deflection cells 208' can form a bi-modal distribution as described herein. The discrete deflection cells 208' can have a similar orientation as the discrete raised portions 206 described above. The continuous or substantially continuous member 206' can have a similar orientation as the continuous or substantially continuous deflection conduit 208' described above.

In one embodiment, one or more of the discrete deflection cells and/or the one or more substantially continuous deflection conduits can comprise a foraminous framework, as illustrated in FIGS. 14-16 at 202. The foraminous framework can be porous to air and water but can be configured to retain fibers thereon.

The fibrous structures of the present disclosure can be made using a molding member. A "molding member" is a structural element that can be used as a support for an embryonic web comprising a plurality of cellulosic fibers and/or a plurality of synthetic fibers as well as to "mold" a desired microscopical geometry of the fibrous structures of the present disclosure. The molding member can comprise any element that has fluid-permeable areas and the ability to impart a microscopical three-dimensional pattern to the fibrous structure being produced thereon, and includes, without limitation, single-layer and multi-layer structures comprising a stationary plate, a belt, a woven fabric (including Jacquard-type and the like woven patterns), a band, and a roll. In one example, the molding member is a papermaking belt as described above with respect to FIGS. 14-18. That is, the papermaking belt can be the same as or similar to the papermaking belts 200 and 200', described above.

A "reinforcing element" is included in some embodiments of the molding member or papermaking belt, serving primarily to provide or facilitate integrity, stability, and durability of the molding member comprising, for example, a resinous material. The reinforcing element can be fluid-permeable or partially fluid-permeable, can have a variety of embodiments and weave patterns, and can comprise a variety of materials, such as, for example, a plurality of interwoven yarns (including Jacquard-type and the like woven patterns), a felt, a plastic, other suitable synthetic material, or any combination thereof. In one embodiment, the reinforcing element can be the reinforcing elements 202 or 202' described above. Other methods for forming a molding member can include patterned nonwovens and printed/extruded polymeric materials on a reinforcing element. In an embodiment resinous materials can be extruded onto a woven reinforcement element having a relatively high amount of texture, such as Jacquard weave, with the resinous material, such a polymeric material, having a negative overburden (resin below the highest elevation of woven elements) and still get the visual impression by blocking out the fabric texture in the "valleys" of the weave. Jacquard weave fabrics can be made according to the disclosure of U.S. Pat. No. 5,429,686; other fabrics useful for the present invention can be as disclosed in U.S. Pat. No. 7,611,607.

In one example of a method for making the fibrous structures of the present disclosure, the method can comprise the step of contacting an embryonic fibrous web with a molding member such that at least one portion of the embryonic fibrous web is deflected out-of-plane of another portion of the embryonic fibrous web. The phrase "out-of-plane" as used herein means that the fibrous structure comprises a protuberance, such as a dome, or a cavity that extends away from the plane of the fibrous structure. The molding member can comprise a through-air-drying fabric having its filaments arranged to produce discrete elements within the fibrous structures of the present disclosure and/or the through-air-drying fabric or equivalent can comprise a resinous framework that defines continuous or substantially continuous deflection conduits or discrete deflection cells that allow portions of the fibrous structure to deflect into the conduits thus forming discrete elements (either relatively high or relatively low density depending on the molding member) within the fibrous structures of the present disclosure. In addition, a forming wire, such as a foraminous member can be used to receive a fibrous furnish and create an embryonic fibrous web thereon.

In another example of a method for making fibrous structures of the present disclosure, the method can comprise the steps of:

(a) providing a fibrous furnish comprising fibers; and (b) depositing the fibrous furnish onto a molding member such that at least one fiber is deflected out-of-plane of the other fibers present on the molding member.

In still another example of a method for making a fibrous structure of the present disclosure, the method comprises the steps of:

(a) providing a fibrous furnish comprising fibers;

(b) depositing the fibrous furnish onto a foraminous member to form an embryonic fibrous web;

(c) associating the embryonic fibrous web with a molding member such that at least one fiber is deflected out-of-plane of the other fibers present in the embryonic fibrous web; and (d) drying said embryonic fibrous web such that that the dried fibrous structure is formed.

In another example of a method for making the fibrous structures of the present disclosure, the method can comprise the steps of:

(a) providing a fibrous furnish comprising fibers;

(b) depositing the fibrous furnish onto a foraminous member such that an embryonic fibrous web is formed;

(c) associating the embryonic web with a molding member comprising discrete deflection cells or substantially continuous deflection conduits;

(d) deflecting the fibers in the embryonic fibrous web into the discrete deflection cells or substantially continuous deflection conduits and removing water from the embryonic web through the discrete deflection cells or substantially continuous deflection conduits so as to form an intermediate fibrous web under such conditions that the deflection of fibers is initiated no later than the time at which the water removal through the discrete deflection cells or the substantially continuous deflection conduits is initiated; and (e) optionally, drying the intermediate fibrous web; and (f) optionally, foreshortening the intermediate fibrous web.

Figure 20:
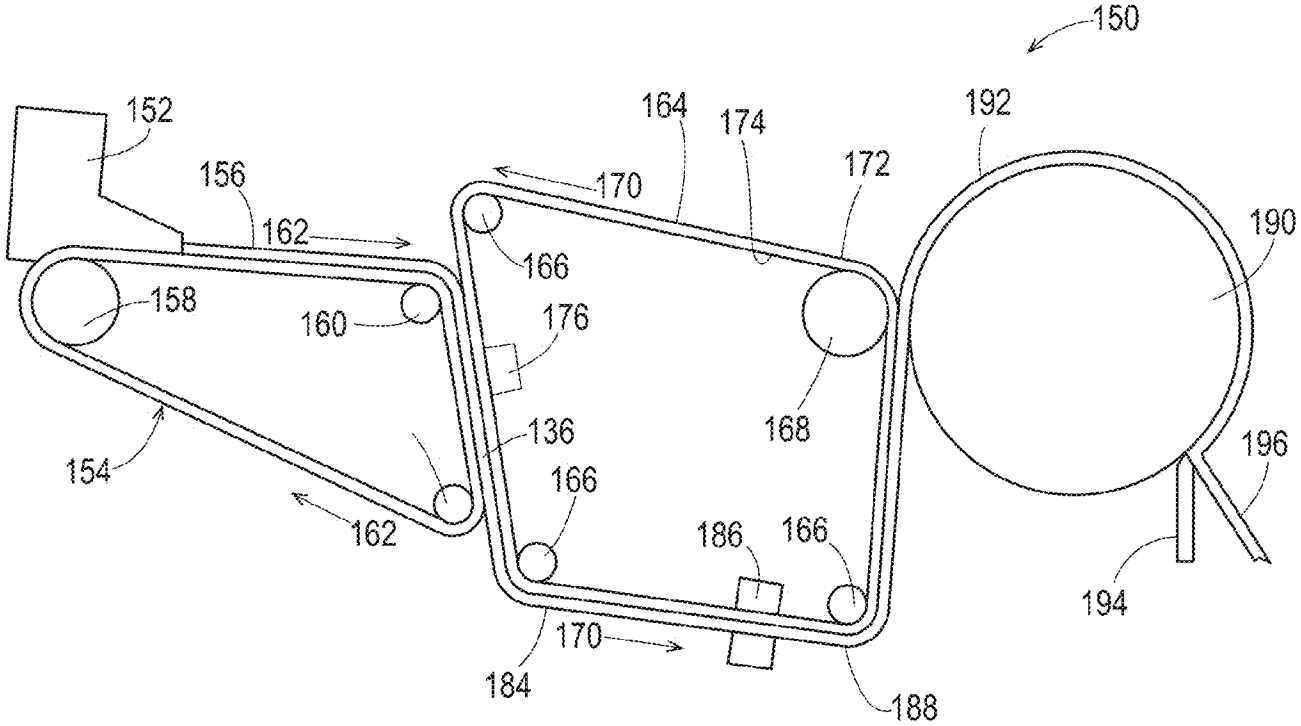
FIG. 20 is an illustration of a process for producing the fibrous structures of the present disclosure.

FIG. 20 is a simplified, schematic representation of one example of a continuous fibrous structure making process and machine useful in the practice of the present disclosure.

As shown in FIG. 20, one example of a process and equipment, represented as 150, for making fibrous structures according to the present disclosure comprises supplying an aqueous dispersion of fibers (a fibrous furnish) to a headbox 152 which can be of any design known to those of skill in the art. From the headbox 152, the aqueous dispersion of fibers can be delivered to a foraminous member 154, which can be a Fourdrinier wire, to produce an embryonic fibrous web 156.

The foraminous member 154 can be supported by a breast roll 158 and a plurality of return rolls 160 of which only two are illustrated. The foraminous member 154 can be propelled in the direction indicated by directional arrow 162 by a drive means, not illustrated, at a predetermined velocity, V1. Optional auxiliary units and/or devices commonly associated with fibrous structure making machines and with the foraminous member 154, but not illustrated, comprise forming boards, hydrofoils, vacuum boxes, tension rolls, support rolls, wire cleaning showers, and other various components known to those of skill in the art.

After the aqueous dispersion of fibers is deposited onto the foraminous member 154, the embryonic fibrous web 156 is formed, typically by the removal of a portion of the aqueous dispersing medium by techniques known to those skilled in the art. Vacuum boxes, forming boards, hydrofoils, and other various equipment known to those of skill in the art are useful in effectuating water removal. The embryonic fibrous web 156 can travel with the foraminous member 154 about return roll 160 and can be brought into contact with a molding member 164, also referred to as a papermaking belt, in a transfer zone 136, after which the embryonic fibrous web travels on the molding member 164. While in contact with the molding member 164, the embryonic fibrous web 156 can be deflected, rearranged, and/or further dewatered.

The molding member 164 can be in the form of an endless belt. In this simplified representation, the molding member 164 passes around and about molding member return rolls 166 and impression nip roll 168 and can travel in the direction indicated by directional arrow 170, at a molding member velocity V2, which can be less than, equal to, or greater than, the foraminous member velocity V1. In the present invention molding member velocity V2 is less than foraminous member velocity V1 such that the partially-dried fibrous web is foreshortened in the transfer zone 136 by a percentage determined by the relative velocity differential between the foraminous member and the molding member. Associated with the molding member 164, but not illustrated, can be various support rolls, other return rolls, cleaning means, drive means, and other various equipment known to those of skill in the art that may be commonly used in fibrous structure making machines.

Regardless of the physical form which the molding member 164 takes, whether it is an endless belt as just discussed or some other embodiment, such as a stationary plate for use in making handsheets or a rotating drum for use with other types of continuous processes, it should have certain physical characteristics. For example, the molding member 164 can take a variety of configurations such as belts, drums, flat plates, and the like.

First, the molding member 164 can be foraminous. That is to say, it may possess continuous passages connecting its first surface 172 (or "upper surface" or "working surface"; i.e., the surface with which the embryonic fibrous web 156 is associated) with its second surface 174 (or "lower surface"; i.e., the surface with which the molding member return rolls 166 are associated). In other words, the molding member 164 can be constructed in such a manner that when water is caused to be removed from the embryonic fibrous web 156, as by the application of differential fluid pressure, such as by a vacuum box 176, and when the water is removed from the embryonic fibrous web 156 in the direction of the molding member 164, the water can be discharged from the system without having to again contact the embryonic fibrous web 156 in either the liquid or the vapor state.

Second, the first surface 172 of the molding member 164 can comprise one or more discrete raised portions 206 or one or more continuous or substantially continuous members 206' as represented in the examples of FIGS. 14-18. The discrete raised portions 206 or the continuous substantially continuous members 206' can be made using any suitable material. For example, a resin, such as a photocurable resin, for example, can be used to create the discrete raised portions 206 or the continuous or substantially continuous member 206'. The discrete raised portions 206 or the continuous or substantially continuous member 206' can be arranged to produce the fibrous structures of the present disclosure when utilized in a suitable fibrous structure making process.

As shown in FIGS. 14-18, the discrete raised portions 206 or the continuous or continuous or substantially continuous member 206' of the papermaking belt 200 or 200' are associated with the reinforcing element 202 or 202', respectively. The reinforcing element 202 or 202' can be made by any suitable material, for example polyester, known to those skilled in the art.

In one example, the molding member 164 can be an endless belt which can be constructed by, among other methods, a method adapted from techniques used to make stencil screens. By "adapted" it is meant that the broad, overall techniques of making stencil screens are used, but improvements, refinements, and modifications as discussed below are used to make the molding member 164 having significantly greater thickness than the usual stencil screen.

Broadly, a reinforcing element 202 or 202' (such as a woven belt) is thoroughly coated with a liquid photosensitive polymeric resin to a preselected thickness. A film or negative incorporating the pattern (e.g., FIG. 3) is juxtaposed on the liquid photosensitive resin. The resin is then exposed to light of an appropriate wave length through the film. This exposure to light causes curing of the resin in the exposed areas (i.e., white portions or non-printed portions in the film). Unexpected (and uncured) resin (under the black portions or printed portions in the film) is removed from the system leaving behind the cured resin forming the pattern illustrated, for example, in FIGS. 14, 16, 17, and 18. Other patterns can also be formed, as discussed herein.

In another example, the molding member 164 can be prepared using as the reinforcing element 202 or 202' of a width and a length suitable for use on a chosen fibrous structure making machine. The patterns can be formed on the reinforcing element 202 or 202' in a series of sections of convenient dimensions in a batchwise manner, (i.e., one section at a time). Details of this nonlimiting example of a process for preparing the molding member follow.

First, a planar forming table is supplied. This forming table should be at least as wide as the width of the reinforcing element 202 or 202' and is of any convenient length. It is provided with means for securing a backing film smoothly and tightly to its surface. Suitable means include provision for the application of vacuum through the surface of the forming table, such as a plurality of closely spaced orifices and tensioning means.

A relatively thin, flexible polymeric (such as polypropylene) backing sheet is placed on the forming table and is secured thereto, as by the application of vacuum or the use of tension. The backing sheet serves to protect the surface of the forming table and to provide a smooth surface from which the cured photosensitive resins will, later, be readily released. This backing sheet will form no part of the completed molding member 164.

Either the backing sheet is of a color which absorbs activating light or the backing sheet is at least semi-transparent and the surface of the forming table absorbs activating light.

A thin layer of adhesive, such as 8091 Crown Spray Heavy Duty Adhesive made by Crown Industrial Products Co. of Hebron, Ill., is applied to the exposed surface of the backing sheet or, alternatively, to the knuckles of the reinforcing element 202 or 202'. A section of the reinforcing element 202 or 202' is then placed in contact with the backing sheet where it is held in place by the adhesive. The reinforcing element 202 or 202' is under tension at the time it is adhered to the backing sheet.

Next, the reinforcing element 202 or 202' is coated with liquid photosensitive resin. As used herein, "coated" means that the liquid photosensitive resin is applied to the reinforcing element 202 or 202' where it is carefully worked and manipulated to insure that all the openings (interstices) in the reinforcing element 202 or 202' are filled with resin and that all of the filaments comprising the reinforcing element 202 or 202' are enclosed with the resin as completely as possible. Since the knuckles of the reinforcing element 202 or 202' are in contact with the backing sheet it will likely not be possible to completely encase the whole of each filament with photosensitive resin. Sufficient additional liquid photosensitive resin is applied to the reinforcing element 202 or 202' to form a molding member 164 having a certain preselected thickness. The molding member 164 can be from about 0.35 mm (0.014 in.) to about 3.0 mm (0.150 in.) in overall thickness. Any technique known to those of skill in the art can be used to control the thickness of the liquid photosensitive resin coating. For example, shims of the appropriate thickness can be provided on either side of the section of the molding member 164 under construction; an excess quantity of liquid photosensitive resin can be applied to the reinforcing element 202 or 202' between the shims; a straight edge resting on the shims and can then be drawn across the surface of the liquid photosensitive resin thereby removing excess material and forming a coating of a uniform thickness.

Suitable photosensitive resins can be readily selected from the many available commercially. They are typically materials, usually polymers, which cure or cross-link under the influence of activating radiation, usually ultraviolet (UV) light. References containing more information about liquid photosensitive resins include Green et al., "Photocross-linkable Resin Systems," J. Macro. Sci-Revs. Macro. Chem, C21 (2), 187-273 (1981-82); Boyer, "A Review of Ultraviolet Curing Technology," Tappi Paper Synthetics Conf. Proc., Sep. 25-27, 1978, pp 167-172; and Schmidle, "Ultraviolet Curable Flexible Coatings," J. of Coated Fabrics, 8, 10-20 (July, 1978). In one example, the discrete raised portions 206 or the continuous or substantially continuous members 206' are made from the Merigraph series of resins made by Hercules Incorporated of Wilmington, Del.

Once the proper quantity (and thickness) of liquid photosensitive resin is coated on the reinforcing element 202 or 202', a cover film is optionally applied to the exposed surface of the resin. The cover film, which must be transparent to light of activating wave length, serves primarily to protect the mask from direct contact with the resin.

A film or negative (e.g., FIG. 7) is placed directly on the optional cover film or on the surface of the resin. This film is formed of any suitable material which can be used to shield or shade certain portions of the liquid photosensitive resin from light while allowing the light to reach other portions of the resin. The design or geometry preselected for the discrete raised portions 206 or the continuous or substantially continuous member 206' is, of course, reproduced in this film in regions which allow the transmission of light while the geometries preselected for the gross foramina are in regions which are opaque to light.

A rigid member such as a glass cover plate is placed atop the mask and serves to aid in maintaining the upper surface of the photosensitive liquid resin in a planar configuration.

The liquid photosensitive resin is then exposed to light of the appropriate wave length through the cover glass, the film, and the cover film in such a manner as to initiate the curing of the liquid photosensitive resin in the exposed areas. It is important to note that when the described procedure is followed, resin which would normally be in a shadow cast by a filament, which is usually opaque to activating light, is cured. Curing this particular small mass of resin aids in making the bottom side of the molding member 164 planar and in isolating one continuous or substantially continuous deflection conduit 208 or a discrete deflection cell 208' from another.

After exposure, the cover plate, the film, and the cover film are removed from the system. The resin is sufficiently cured in the exposed areas to allow the reinforcing element 202 or 202' along with the resin (together the molding member 164 to be stripped from the backing film).

Uncured resin is removed from the reinforcing element 202 or 202' by any convenient method, such as vacuum removal and aqueous washing, for example.

A section of the molding member 164 is now essentially in final form. Depending upon the nature of the photosensitive resin and the nature and amount of the radiation previously supplied to it, the remaining, at least partially cured, photosensitive resin can be subjected to further radiation in a post curing operation as required.

The backing sheet is stripped from the forming table and the process is repeated with another section of the reinforcing element 202 or 202'. Conveniently, the reinforcing element 202 or 202' is divided off into sections of essentially equal and convenient lengths which are numbered serially along its length. Odd numbered sections are sequentially processed to form sections of the molding member 164 and then even numbered sections are sequentially processed until the entire molding member 164 possesses the required characteristics. The reinforcing element 202 or 202' can be maintained under tension at all times.

In the method of construction just described, the knuckles of the woven belt actually form a portion of the bottom surface of the molding member 164. The reinforcing element 202 or 202' can be physically spaced from the bottom surface.

Multiple replications of the above described technique can be used to construct molding members 164 having the more complex geometries.

The molding members 164 of the present disclosure can be made, or partially made, according to the process described in U.S. Pat. No. 4,637,859, issued Jan. 20, 1987, to Trokhan.

After the embryonic fibrous web 156 has been associated with the molding member 164, fibers within the embryonic fibrous web 156 are deflected into the continuous or substantially continuous deflection conduits 208 or the discrete deflection cells 208' present in the molding members 164. In one example of this process step, there is essentially no water removal from the embryonic fibrous web 156 through the continuous or substantially continuous deflection conduits 208 or the discrete deflection cells 208' after the embryonic fibrous web 156 has been associated with the molding members 164 but prior to the deflecting of the fibers into the continuous or substantially continuous deflection conduits 208 or the discrete deflection cells 208'. Further water removal from the embryonic fibrous web 156 can occur during and/or after the time the fibers are being deflected into the continuous or substantially continuous deflection conduits 208 or the discrete deflection cells 208'. Water removal from the embryonic fibrous web 156 can continue until the consistency of the embryonic fibrous web 156 associated with the molding member 164 is increased to from about 25% to about 35%. Once this consistency of the embryonic fibrous web 156 is achieved, then the embryonic fibrous web 156 is referred to as an intermediate fibrous web 184. During the process of forming the embryonic fibrous web 156, sufficient water can be removed, such as by a noncompressive process, from the embryonic fibrous web 156 before it becomes associated with the molding member 164 so that the consistency of the embryonic fibrous web 156 can be from about 10% to about 30%.

While the inventors decline to be bound by any particular theory of operation, it appears that the deflection of the fibers in the embryonic web and water removal from the embryonic web begin essentially simultaneously. Embodiments can, however, be envisioned wherein deflection and water removal are sequential operations. Under the influence of the applied differential fluid pressure, for example, the fibers can be deflected into the continuous or substantially continuous deflection conduits 208 or the discrete deflection cells 208' with an attendant rearrangement of the fibers. Water removal can occur with a continued rearrangement of fibers. Deflection of the fibers, and of the embryonic fibrous web, can cause an apparent increase in surface area of the embryonic fibrous web. Further, the rearrangement of fibers can appear to cause a rearrangement in the spaces or capillaries existing between and/or among fibers.

It is believed that the rearrangement of the fibers can take one of two modes dependent on a number of factors such as, for example, fiber length. The free ends of longer fibers can be merely bent in the space defined by the continuous or substantially continuous deflection conduits 208 or the discrete deflection cells 208' while the opposite ends are restrained in the region of the discrete raised portions 206 or the substantially continuous member 206'. Shorter fibers, on the other hand, can actually be transported from the region of the discrete raised portions 206 or the substantially continuous member 206' into the continuous or substantially continuous deflection conduits 208 or the discrete deflection cells 208' (The fibers in the continuous or substantially continuous deflection conduits 208 or the discrete deflection cells 208' can also be rearranged relative to one another). Naturally, it is possible for both modes of rearrangement to occur simultaneously.

As noted, water removal occurs both during and after deflection; this water removal can result in a decrease in fiber mobility in the embryonic fibrous web. This decrease in fiber mobility may tend to fix and/or freeze the fibers in place after they have been deflected and rearranged. Of course, the drying of the web in a later step in the process of this disclosure serves to more firmly fix and/or freeze the fibers in position.

Any convenient methods conventionally known in the papermaking art can be used to dry the intermediate fibrous web 184. Examples of such suitable drying process include subjecting the intermediate fibrous web 184 to conventional and/or flow-through dryers and/or Yankee dryers.

In one example of a drying process, the intermediate fibrous web 184 in association with the molding member 164 passes around a molding member return roll 166 and travels in the direction indicated by directional arrow 170. The intermediate fibrous web 184 can first pass through an optional predryer 186. This predryer 186 can be a conventional flow-through dryer (hot air dryer) known to those skilled in the art. Optionally, the predryer 186 can be a so-called capillary dewatering apparatus. In such an apparatus, the intermediate fibrous web 184 passes over a sector of a cylinder having preferential-capillary-size pores through its cylindrical-shaped porous cover. Optionally, the predryer 186 can be a combination capillary dewatering apparatus and flow-through dryer. The quantity of water removed in the predryer 186 can be controlled so that a predried fibrous web 188 exiting the predryer 86 has a consistency of from about 30% to about 98%. The predried fibrous web 188, which can still be associated with papermaking belt 200, can pass around another papermaking belt return roll 166 and as it travels to an impression nip roll 168. As the predried fibrous web 188 passes through the nip formed between impression nip roll 168 and a surface of a Yankee dryer 190, the pattern formed by the top surface 172 of the molding member 164 is impressed into the predried fibrous web 188 to form discrete elements (relatively high density) or, alternatively, a substantially continuous network (relatively high density) imprinted in the fibrous web 192. The imprinted fibrous web 192 can then be adhered to the surface of the Yankee dryer 190 where it can be dried to a consistency of at least about 92%. The Yankee dryer can rotate at a predetermined rate to have a Yankee surface velocity, i.e., web speed, V3.

The imprinted fibrous web 192 can then be creped with a creping blade 194 to remove the web 192 from the surface of the Yankee dryer 190 resulting in the production of a creped fibrous structure 196 in accordance with the present disclosure. As used herein, creping refers to the reduction in length of a dry (having a consistency of at least about 90% and/or at least about 95%) fibrous web which occurs when energy is applied to the dry fibrous web in such a way that the length of the fibrous web is reduced and the fibers in the fibrous web are rearranged with an accompanying disruption of fiber-fiber bonds. Creping can be accomplished in any of several ways as is well known in the art. The creped fibrous structure 196 is wound on a reel, commonly referred to as a parent roll, and can be subjected to post processing steps such as calendaring, tuft generating operations, embossing, and/or converting. The reel winds the creped fibrous structure at a reel surface velocity, V4.

The molding member/papermaking belts of the present disclosure can be utilized to imprint discrete elements and a substantially continuous network into a fibrous structure during a through-air-drying operation.

However, such molding members/papermaking belts can also be utilized as forming members or foraminous members upon which a fiber slurry is deposited.

As discussed above, the fibrous structure can be embossed during a converting operating to produce the fibrous structures of the present disclosure. For example, the discrete elements and/or the continuous or substantially continuous network can be imparted to a fibrous structure by embossing.

An example of fibrous structures in accordance with the present disclosure can be prepared using a papermaking machine as described above with respect to FIG. 20, and according to the method described below.

A 3% by weight aqueous slurry of northern softwood kraft (NSK) pulp is made up in a conventional re-pulper. The NSK slurry is refined gently and a 2% solution of a permanent wet strength resin (i.e. Kymene 5221 marketed by Hercules incorporated of Wilmington, Del.) is added to the NSK stock pipe at a rate of 1% by weight of the dry fibers. Kymene 5221 is added as a wet strength additive. The adsorption of Kymene 5221 to NSK is enhanced by an in-line mixer. A 1% solution of Carboxy Methyl Cellulose (CMC) (i.e. FinnFix 700 marketed by C.P. Kelco U.S. Inc. of Atlanta, Ga.) is added after the in-line mixer at a rate of 0.2% by weight of the dry fibers to enhance the dry strength of the fibrous substrate. A 3% by weight aqueous slurry of hardwood Eucalyptus fibers is made up in a conventional re-pulper. A 1% solution of defoamer (i.e. BuBreak 4330 marketed by Buckman Labs, Memphis Tenn.) is added to the Eucalyptus stock pipe at a rate of 0.25% by weight of the dry fibers and its adsorption is enhanced by an in-line mixer.

The NSK furnish and the Eucalyptus fibers are combined in the head box and deposited onto a Fourdrinier wire, running at a first velocity $V_1$, homogenously to form an embryonic web. The web is then transferred at the transfer zone from the Fourdrinier forming wire at a fiber consistency of about 15% to the molding member, the molding member moving at a second velocity, $V_2$. The molding member has a pattern of discrete raised portions extending from a reinforcing element, discrete raised portions defining a substantially continuous deflection conduit portion, as described herein, particularly with reference to FIGS. 13A to 16. The transfer occurs in the transfer zone without precipitating substantial densification of the web. The web is then forwarded, at the second velocity, $V_2$, on the molding member along a looped path in contacting relation with a transfer head disposed at the transfer zone, the second velocity being from about 1% to about 40% slower than the first velocity, $V_1$. Since the Fourdrinier wire speed is faster than the molding member, wet shortening, i.e., foreshortening, of the web occurs at the transfer point. In an embodiment the second velocity $V_2$ can be from about 0% to about 5% faster than the first velocity $V_1$.

Further de-watering is accomplished by vacuum assisted drainage until the web has a fiber consistency of about 15% to about 30%. The patterned web is pre-dried by air blow-through, i.e., through-air-drying (TAD), to a fiber consistency of about 65% by weight. The web is then adhered to the surface of a Yankee dryer with a sprayed creping adhesive comprising 0.25% aqueous solution of polyvinyl alcohol (PVA). The fiber consistency is increased to an estimated 95%-97% before dry creping the web with a doctor blade. The doctor blade has a bevel angle of about 45 degrees and is positioned with respect to the Yankee dryer to provide an impact angle of about 101 degrees. This doctor blade position permits the adequate amount of force to be applied to the substrate to remove it off the Yankee while minimally disturbing the previously generated web structure. The dried web is reeled onto a take up roll (known as a parent roll), the surface of the take up roll moving at a fourth velocity, $V_4$, that is faster than the third velocity, $V_3$, of the Yankee dryer. By reeling at a fourth velocity, $V_4$, that is about 1% to 20% faster than the third velocity, $V_3$, some of the foreshortening provided by the creping step is "pulled out," sometimes referred to as a "positive draw," so that the paper can be more stable for any further converting operations.

Two plies of the web can be formed into paper towel products by embossing and laminating them together using PVA adhesive. The paper towel has about 53 g/m$^2$ basis weight and contains 65% by weight Northern Softwood Kraft and 35% by weight Eucalyptus furnish.

The sanitary tissue product is soft, flexible and absorbent.

In the interests of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of 1-5 shall be considered to support claims to any of the following sub-ranges: 1-4; 1-3; 1-2; 2-5; 2-4; 2-3; 3-5; 3-4; and 4-5.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any embodiment disclosed or claimed herein or that it alone, or in any combination with any other reference or references, teaches, suggests or discloses any such embodiment. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the present disclosure. It is therefore intended to cover in the appended claims all such changes and modifications that are within the scope of this disclosure.

What is claimed is:

1. A method for making a fibrous structure, the method comprising the steps of:

depositing a slurry of pulp fibers from a headbox of a paper making machine onto a Fourdrinier wire running at a first velocity $V_1$ to form an embryonic web;

transferring the embryonic web from the Fourdrinier wire to at least a first molding member moving at a second velocity, $V_2$, where the second velocity, $V_2$, is slower than the first velocity, $V_1$, and the molding member comprises a substantially continuous relatively low density network at least partially defining a plurality of relatively high density, irregularly shaped, discrete elements situated in an irregular pattern, wherein each of the discrete element has at least one arcuate portion on their outer perimeter, a major axis, A, and a minor axis, B, and wherein the length of the major axis, A, is greater than or equal to the length of the minor axis, B;

de-watering the embryonic web by through air drying to at least partially dry it;

adhering the partially dried web to a Yankee dryer surface for further drying, the Yankee dryer surface moving at a third velocity, $V_3$, to dry the web to a dry web consistency of at least 92%;

creping the dried web off the Yankee dryer with a doctor blade; and reeling the creped, dried web onto a take up roll, the take up roll having a fourth velocity, $V_4$, that is faster than the third velocity, $V_3$, of the Yankee dryer.

2. The method of claim 1, wherein the pulp fibers comprise softwood and hardwood fibers.

3. The method of claim 1, wherein the embryonic web is at a consistency of about 15% when transferred to the molding member.

4. The method of claim 1, wherein the second velocity $V_2$ is between 1% and 40% slower than first velocity $V_1$.

5. The method of claim 1, wherein the doctor blade is positioned with respect to the Yankee dryer surface to provide an impact angle of about 99-116 degrees.

6. The method of claim 1, wherein the doctor blade is positioned with respect to the Yankee dryer surface to provide an impact angle of about 97-103 degrees.

7. The method of claim 1, wherein each major axis, A, of each of the discrete elements extends at an angle in the range of about −90 degrees to about 90 degrees relative to a machine direction of 0 degrees, and wherein the distribution of the angles between about −90 degrees and about 90 degrees is bimodal.

8. A method for making a multiply fibrous structure, the method comprising the steps of:

depositing a slurry of pulp fibers from a headbox of a paper making machine onto a Fourdrinier wire running at a first velocity $V_1$ to form an embryonic web;

transferring the embryonic web from the Fourdrinier wire to at least at least a first molding member moving at a second velocity, $V_2$, where the second velocity, $V_2$, is slower than the first velocity, $V_1$, and the molding member comprises a substantially continuous relatively low density network at least partially defining a plurality of relatively high density, irregularly shaped, discrete elements situated in an irregular pattern, wherein each of the discrete element has at least one arcuate portion on their outer perimeter, a major axis, A, and a minor axis, B, and wherein the length of the major axis, A, is greater than or equal to the length of the minor axis, B;

de-watering the embryonic web by through air drying to at least partially dry it;

adhering the partially dried web to a Yankee dryer surface for further drying, the Yankee dryer surface moving at a third velocity, $V_3$, to dry the web to a dry web consistency of at least 92%;

creping the dried web off the Yankee dryer with a doctor blade;

reeling the creped, dried web onto a take up roll, the take up roll having a fourth velocity, $V_4$, that is faster than the third velocity, $V_3$, of the Yankee dryer; and combining the dried web with another fibrous web to form a multiply fibrous structure.

9. The method of claim 8, wherein the pulp fibers comprise softwood and hardwood fibers.

10. The method of claim 8, wherein the embryonic web is at a consistency of about 15% when transferred to the molding member.

11. The method of claim 8, wherein the second velocity $V_2$ is between 1% and 40% slower than first velocity $V_1$.

12. The method of claim 8, wherein the doctor blade is positioned with respect to the Yankee dryer surface to provide an impact angle of about 99-116 degrees.

13. The method of claim 8, wherein the doctor blade is positioned with respect to the Yankee dryer surface to provide an impact angle of about 97-103 degrees.

14. The method of claim 8, wherein each major axis, A, of each of the discrete elements extends at an angle in the range of about −90 degrees to about 90 degrees relative to a machine direction of 0 degrees, and wherein the distribution of the angles between about −90 degrees and about 90 degrees is bimodal.

15. A method for making a fibrous structure, the method comprising the steps of:

depositing a slurry of pulp fibers from a headbox of a paper making machine onto a Fourdrinier wire running at a first velocity $V_1$ to form an embryonic web;

transferring the embryonic web from the Fourdrinier wire to at least at least a first molding member moving at a second velocity, $V_2$, where the second velocity, $V_2$, is slower than the first velocity, $V_1$, and the molding member comprises a substantially continuous relatively low density network at least partially defining a plurality of relatively high density, irregularly shaped, discrete elements situated in an irregular pattern, wherein at least two of the discrete elements have different areas, wherein each of the discrete elements has a major axis, A, and a minor axis, B, and wherein the ratio of the length of the major axis, A, to the length of the minor axis, B, is greater than 1;

de-watering the embryonic web by through air drying to at least partially dry it;

adhering the partially dried web to a Yankee dryer surface for further drying, the Yankee dryer surface moving at a third velocity, $V_3$, to dry the web to a dry web consistency of at least 92%;

creping the dried web off the Yankee dryer with a doctor blade positioned to provide; and reeling the creped, dried web onto a take up roll, the take up roll having a fourth velocity, $V_4$, that is faster than the third velocity, $V_3$, of the Yankee dryer.

16. The method of claim 15, wherein the pulp fibers comprise softwood and hardwood fibers.

17. The method of claim 15, wherein the second velocity $V_2$ is between 1% and 40% slower than first velocity $V_1$.

18. The method of claim 15, wherein the doctor blade is positioned with respect to the Yankee dryer surface to provide an impact angle of about 99-116 degrees.

19. The method of claim 15, wherein the doctor blade is positioned with respect to the Yankee dryer surface to provide an impact angle of about 97-103 degrees.

20. The method of claim 15, wherein each major axis, A, of each of the discrete elements extends at an angle in the range of about −90 degrees to about 90 degrees relative to a machine direction of 0 degrees, and wherein the distribution of the angles between about −90 degrees and about 90 degrees is bimodal.

* * * * *